US010030407B1

(12) United States Patent
Beedle et al.

(10) Patent No.: US 10,030,407 B1
(45) Date of Patent: Jul. 24, 2018

(54) ADJUSTABLE CANOPY AND SHADE SYSTEM FOR OFFICE WORKSPACE

(71) Applicant: Sierra Pacific Ventures LLC, Alamo, CA (US)

(72) Inventors: Edwin Beedle, Alamo, CA (US); Mary Beedle, Alamo, CA (US); Michael J. Strasser, San Francisco, CA (US); Imraan Aziz, Oakland, CA (US); Thomas E. King, San Francisco, CA (US); William G. Tammen, Redwood City, CA (US)

(73) Assignee: SIERRA PACIFIC VENTURES LLC, Alamo, CA (US)

( * ) Notice: Subject to any disclaimer, the term of this patent is extended or adjusted under 35 U.S.C. 154(b) by 0 days.

(21) Appl. No.: 14/963,185

(22) Filed: Dec. 8, 2015

Related U.S. Application Data

(60) Provisional application No. 62/089,324, filed on Dec. 9, 2014, provisional application No. 62/182,428, filed on Jun. 19, 2015.

(51) Int. Cl.
*E04H 15/58* (2006.01)
*E04H 15/34* (2006.01)
*E04H 15/54* (2006.01)

(52) U.S. Cl.
CPC ..... *E04H 15/34* (2013.01); *E04H 15/54* (2013.01); *E04H 15/58* (2013.01)

(58) Field of Classification Search
CPC ..... E04H 15/02; E04H 15/48; E04H 15/54; E04H 15/58; A45B 23/00; A45B 2200/1009; A45B 2023/0031; A45B 2023/0093; F16M 13/02; F16M 11/08; E06B 9/00; E06B 9/24
USPC ..... 135/16, 90, 96, 155, 161, 117, 119; 52/36.1–36.2, 83; 108/50.12, 144.11, 108/147.18; 248/276.1, 278.1; 297/184.1, 184.15
See application file for complete search history.

(56) References Cited

U.S. PATENT DOCUMENTS 437,336 A 9/1890 Giebel
4,865,380 A * 9/1989 Heitzman-Powell .... B60N 2/44 135/96

(Continued)

FOREIGN PATENT DOCUMENTS

WO 2004022871 A2 3/2004

*Primary Examiner* — Winnie Yip
(74) *Attorney, Agent, or Firm* — Loginov & Associates; William A. Loginov

(57) ABSTRACT

This invention provides an adjustable canopy system for a workspace that includes a perimeter frame that exerts tension on a fabric piece, and defines illustratively, an ovular outline shape. The fabric piece can include a central/spine rod that is external, or internal of the fabric, so as to define a V-shaped cross section. The canopy element is mounted on an arm assembly so that it rotates to adjust tilt. The arm assembly also includes a multi-dimensional joint that allows for motion in a plurality of degrees of freedom. Illustratively, the multi-dimensional joint exerts selectable holding friction that retains the joint at a predetermined orientation, but allows movement under appropriate biasing force by a user. The multi-dimensional joint is mounted on the end of an upright. A base clamp is mounted with respect to a slot/groove or on an edge of the desktop.

19 Claims, 26 Drawing Sheets

(56) References Cited

U.S. PATENT DOCUMENTS 5,033,528 A * 7/1991 Volcani ..... A45B 17/00 160/351
5,177,912 A 1/1993 Ball
5,301,999 A * 4/1994 Thompson ..... B60N 2/26 248/284.1
5,727,583 A 3/1998 Kennedy
5,937,882 A 8/1999 Harbaugh
6,234,187 B1 5/2001 Izzo
6,244,286 B1 6/2001 Russo
6,293,292 B1 * 9/2001 Watzke ..... A47C 7/66 135/123
6,405,742 B1 * 6/2002 Driscoll ..... A45B 11/00 135/20.1
6,575,183 B2 6/2003 Tung
6,769,747 B2 * 8/2004 Chan ..... A47B 21/00 108/157.16
6,845,780 B2 1/2005 Bishirjian
7,032,523 B2 4/2006 Forslund, III et al.
D522,605 S 6/2006 Bishirjian
7,117,802 B2 10/2006 Hoke, Jr. et al.
7,566,095 B2 7/2009 Reeb et al.
7,658,199 B2 2/2010 Ayers et al.
8,225,723 B2 * 7/2012 Nakamura ..... A47B 17/00 108/27
8,316,986 B2 11/2012 Quasney et al.
8,439,055 B2 5/2013 April et al.
8,740,165 B2 * 6/2014 O'Kasick ..... F16M 11/10 248/276.1
8,807,513 B2 8/2014 Volin
8,845,016 B2 * 9/2014 Domash ..... A47C 7/62 248/123.11
9,140,406 B2 * 9/2015 Simon ..... F16M 13/022
2002/0073900 A1 6/2002 Birsel et al.
2003/0140823 A1 7/2003 Hoke, Jr. et al.
2004/0250480 A1 * 12/2004 Matthai ..... A47B 21/00 52/36.1
2006/0243311 A1 11/2006 Glatz
2008/0142058 A1 * 6/2008 Chan ..... A45B 23/00 135/20.1
2009/0096257 A1 * 4/2009 Gordon ..... B62B 9/142 297/184.12
2014/0150837 A1 6/2014 Darquea et al.

* cited by examiner

ADJUSTABLE CANOPY AND SHADE SYSTEM FOR OFFICE WORKSPACE

RELATED APPLICATIONS

This application claims the benefit of U.S. Provisional Application Ser. No. 62/089,324, entitled ADJUSTABLE CANOPY SYSTEM FOR OFFICE WORKSPACE, filed Dec. 9, 2014 and U.S. Provisional Application Ser. No. 62/182,428, entitled ADJUSTABLE CANOPY SYSTEM AND SHADE FOR OFFICE WORKSPACE, filed Jun. 19, 2015, the teachings of each of which application are expressly incorporated herein by reference.

FIELD OF THE INVENTION

This invention relates to office workspace accessories and more particularly to accessories for providing privacy and cover to desks and cubicles.

BACKGROUND OF THE INVENTION

Desks and cubicle arrangements are a ubiquitous part of a modern work environment. Many manufacturers provide walls, shelves desk work surfaces, drawers, bins and other modular components that enable an employer to arrange an overall work area with selected degrees of storage, workspace (surface area) and privacy for personnel who perform various tasks within an organization. It is common for workers to reside in a cubicle space that includes privacy screens, walls and sometimes doors. However, the overhead space of the cubicle is open wide open to the greater office environment. This can lead to undesirable conditions in which air drafts, glare from windows and lighting, and peering eyes all degrade the worker's environment.

There exist canopy systems particularly applicable to cubicle spaces, some of which are attached to the walls of the unit and overlie a large portion of the workspace area from a location above the top edge of the walls. An example of such a canopy is shown and described in U.S. Pat. No. 7,117,802, entitled CUBICLE SHIELD Undesirably, this canopy, and others like it are relatively fixed once installed and can interfere with movement of the worker about the cubicle. More generally, they are not readily adjustable to accommodate changes in worker position, lighting and the like. They are also somewhat cumbersome and can lack style—appearing more like a tent than an office accessory.

It is, thus, desirable to provide a canopy system that overcomes some or all of the above disadvantages.

SUMMARY OF THE INVENTION

This invention overcomes disadvantages of the prior art by providing an adjustable canopy system for a workspace that is aesthetically pleasing and stylish, lightweight and easy to move and readjust to differing orientations and locations within the cubicle space. This canopy is freestanding or mounts at a lower position, illustratively by removably clamping to a desk surface (for example, at a conventional desktop cut-through for cabling). The canopy element includes a perimeter frame that exerts tension on a fabric piece, and defines illustratively, an ovular outline shape. The fabric piece can include a spine rod that is external, or internal of the fabric, so as to define a V-shaped cross section with a medial groove viewed transverse the elongated direction of the canopy. The canopy element is mounted on an arm assembly that enables it to rotate on a wrist joint about a rotational axis in the elongated direction. The arm assembly includes a multi-dimensional joint at the opposing end thereof that allows for motion in a plurality of degrees of freedom (about a plurality of rotational axes). Illustratively, the multi-dimensional joint can be a ball and socket joint with a screw-adjusted tensioning element to exert friction that retains the joint at a predetermined orientation, but allows movement under appropriate biasing force by a user. Alternatively, the multi-dimensional joint can be a pivoting yoke mounted on the end of with an orthogonal pivot for the end of the arm assembly, both of which can be locked into a predetermined orientation by the user. The multi-dimensional joint in each example is mounted on the end of an upright that is removably secured (e.g. by a clamp) to the desktop. Illustratively, the clamp is mounted with respect to a cut-through cable passage of conventional arrangement and design within the perimeter of the desktop or on an edge of the desktop.

In an illustrative embodiment, a canopy system for a desktop or other supporting surface includes a base; an upright extending upwardly from the base to a joint arrangement allowing rotation in at least two degrees of rotational freedom; an arm assembly attached to the joint arrangement; and a canopy element having a framework and a fabric piece supported by the framework, an end of the canopy element attached to arm assembly. The joint arrangement can comprise a multi-dimensional joint, such as a ball-and-socket joint. A brake member selectively applies a holding force to a ball of the ball-and-socket joint. Alternatively, the multi-dimensional joint allows rotation about at least two discrete axes of rotation, constructed and arranged so that a selectively applicable braking force against rotation about a first axis of the axes is greater than a braking force against rotation in at least a second axis of the axes. This example of a multi-dimensional joint includes a first pivot that allows rotation about the first axis and a second pivot that allows rotation about the second axis. The first pivot is oriented to allow up and down motion of the arm assembly, and the second pivot is oriented to allow right and left motion of the arm assembly. In this arrangement, a wrist joint allows tilt between the arm assembly and the canopy element. Illustratively, the framework can include perimeter rods that tension the fabric between opposing end caps and a spine rod that extends between the opposing end caps. The wrist joint assembly resides at one of the end caps. Illustratively, the spine rod is either embedded within the fabric to define a V-shaped ventral groove or is external of the fabric. The arm assembly can define a rearward segment that counterbalances weight with respect to the joint arrangement, and the base can constructed and arranged to enable freestanding support thereof on a surface with counterbalance assisting in the stability of the system in such a freestanding orientation. The base can also include a clamping arrangement constructed and arranged to pressurably engage a thickness of a supporting surface. Illustratively, the clamping arrangement can be constructed and arranged to engage a slot on a supporting surface, and the slot can comprise a grommet or cable handling slot on a cubicle desk system desktop. Illustratively, the clamping arrangement can include a screw-operated clamp member with a clamping plate that movably engages an underside of the supporting surface, and the clamping plate can be selectively positioned in slots of differing heights in the clamping arrangement.

In another illustrative embodiment, a shade system for an office or other workspace is provided. The shade system includes a base assembly that mounts via clamp(s), fasteners or another appropriate mechanism to a surface, such as a desktop. The support assembly can comprise a conventional multi-axis, adjustable monitor mounting system—for example using a VESA-style mount and the shade assembly comprises a base member, which engages the assembly at a rotating joint thereof, and that interconnects a shade frame. The shade frame includes an outer perimeter that defines the shape of the shade (e.g. a circle, oval, rectangle, square, regular or irregular polygon) and a supporting frame assembly that provides a secure, unitary or integral interconnection between the frame and the base member. The rib assembly can be secured by screw or another fastening system (e.g. adhesives). The shade material is highly variable. In embodiments, the shade material can be transparent or translucent, and can include visible, near-visible (e.g. UV, IR, etc.) and/or RF-filtering properties that, for example, provide a desired hue or shade to light transmitted thereto.

In an illustrative embodiment, the perimeter shape of the shade is oval or rectangular. The shade is constructed from (e.g.) frosted polycarbonate or acrylic polymer (plastic) that provides inherent rigidity and structural integrity with minimal support in spans of over 12 inches (width and/or length). The shade support assembly consists of a one piece aluminum bar which runs approximately 60% of the way down the center of the shade (or an alternate horseshoe support around most of the perimeter of the shade).

The exemplary, frosted polymer material gently diffuses the light into a variety of colors and creates a subtle color hue or tint at the desk. A variety of non-white and/or non-transparent colors can be provided as a translucent tint and/or the shade material can be black/light-blocking. The shade also protects the user from over 90% of harmful UV rays. As the light shines through the acrylic plastic, the light changes color. Studies have been done to show that colored light effects the mood of the user, and this is especially important in the office environment as certain colored lights are know to increase creativity and productivity.

In an embodiment, the shade is mounted on two angled/inclined arm members that are mounted to an upright cylindrical pole or post. This arrangement can be based on a conventional computer monitor mount/stand design. A variety of alternate monitor mounts/stands can be employed. Notably, the shade is adapted for use with a monitor mounts that employ a variety of configurations and adjustment mechanisms. By using the two inclined arm members, the shade can be set at the maximum height with minimal force exerted on the pole, allows for a relatively low height pole. With the inclined arm members mounted to the pole, the user is able to comfortably sit under the shade using 24-inch pole and stand under the shade utilizing a 30-inch pole (note that the maximum height when mounted to a 29-inch-high standard desktop is approximately 6 feet 2 inches).

In an illustrative embodiment, a personal adjustable shade system for a workspace is provided. The system includes a shade assembly having a perimeter edge and a sheet material contained therein. The perimeter edge can define a predetermined perimeter shape. A support frame is connected to the sheet material, including a base member. The support frame can define a raised rib that can be separate or unitary with the sheet material. A support assembly is provided having a mounting end that interconnects to the base member of the supporting frame, and a plurality of joints are constructed and arranged to enable the shade assembly to be moved in a plurality of degrees of freedom. Illustratively, the mounting end and the base member are interconnected by a rotary joint. The rotary joint can define a securing screw and a friction-generating member. The support assembly can further include an upright post arranged to be attached to a desktop, and define a conventional monitor mount. By way of non-limiting example, the monitor mount can comprises a VESA monitor mount. Illustratively, the supporting frame defines either a perimeter mounted frame or a central bar, interconnected to the sheet material. The sheet material can comprise a frosted translucent polymer. The polymer can defines a non-clear and non-white tint, or the tint can be black/light-blocking. Alternatively, the tint can be translucent white or a non-white translucent color.

BRIEF DESCRIPTION OF THE DRAWINGS

The invention description below refers to the accompanying drawings, of which.

DETAILED DESCRIPTION

I. Adjustable Canopy System

Figure 1:
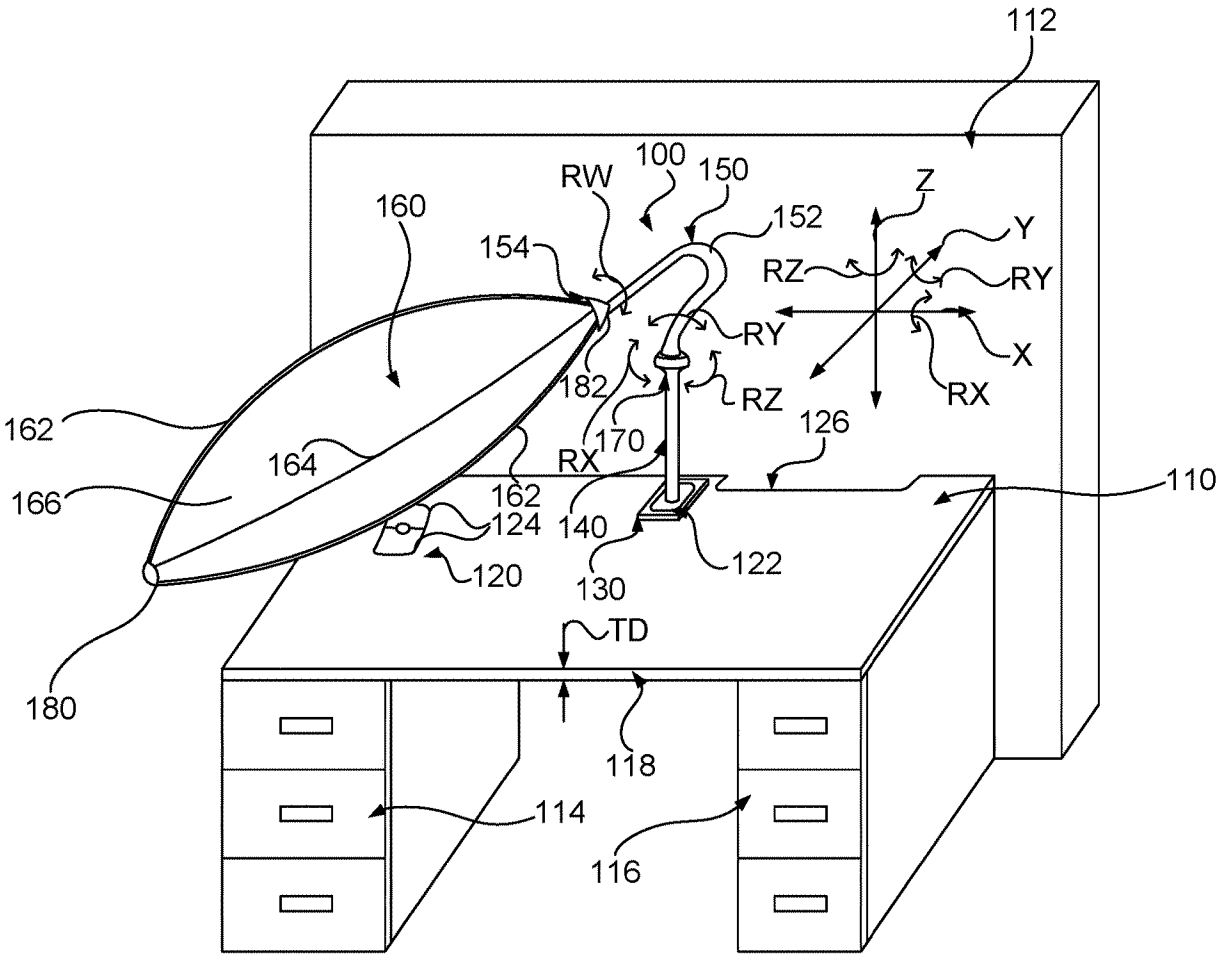
FIG. 1 is a diagram of an exemplary desk with the canopy system in accordance with an illustrative embodiment mounted on a desktop thereof.

Reference is made to FIG. 1, which shows a canopy system 100 that is mounted on a typical desk arrangement 110, which can be integrated with a cubicle (e.g. cubicle wall 112). The desk 110 can include a variety of features, such as drawer sets 114, 116 and a desktop 118. The desktop 118 defines a predetermined thickness TD that can typically range from approximately ¾ inch to 2.5 inches or more. The desktop includes one or more through-cut cable chases 120 and 122 (shown in phantom). In this example, the cable chases 120 and 122 (also termed "grommets") are approximately rectangular in shape (double sized with a pair of removable covers 124, and defining dimensions of approximately 3.0-3.5×2.0-2.25 inches. This cable chase arrangement is exemplary of a variety of types of chase geometries that can be used in conjunction with the canopy system herein. For example, ovular, circular, and/or elongated, open cable slots 126 can be employed. As described further below, the grommet receives a clamping arrangement at the base 130 of the canopy system 100 that secures the system in place on the desktop 118 through the grommet hole (122) or other opening in the desktop (e.g. the cable slot 126). According to further aspects, the clamping arrangement at the base can secure the system 100 to a side or front edge of the desktop in the manner of another clamp-on accessory, such as a desk lamp. Moreover, the base can clamp to the rear edge of a desktop or similar surface provided that a (typical) gap exists between the rear edge (or another land-locked edge) and the back wall of the cubicle or other vertical structure. Alternatively, if the cubicle is padded, the material can be compressed to provide clearance for the clamp to pass along the back of the desktop to a desired mounting position.

Notably, the canopy system 100, according to aspects of the disclosure is secured to (or resides freestanding upon) the desktop 118 rather than to the wall(s) (112) of the cubicle, allowing its use on a unobstructed/unenclosed desk arrangement (free of cubicle wall(s)), and more generally in a manner that does not break/obscure the lines of the cubicle wall structure, or extend outside the environs of the cubicle.

Figure 2:
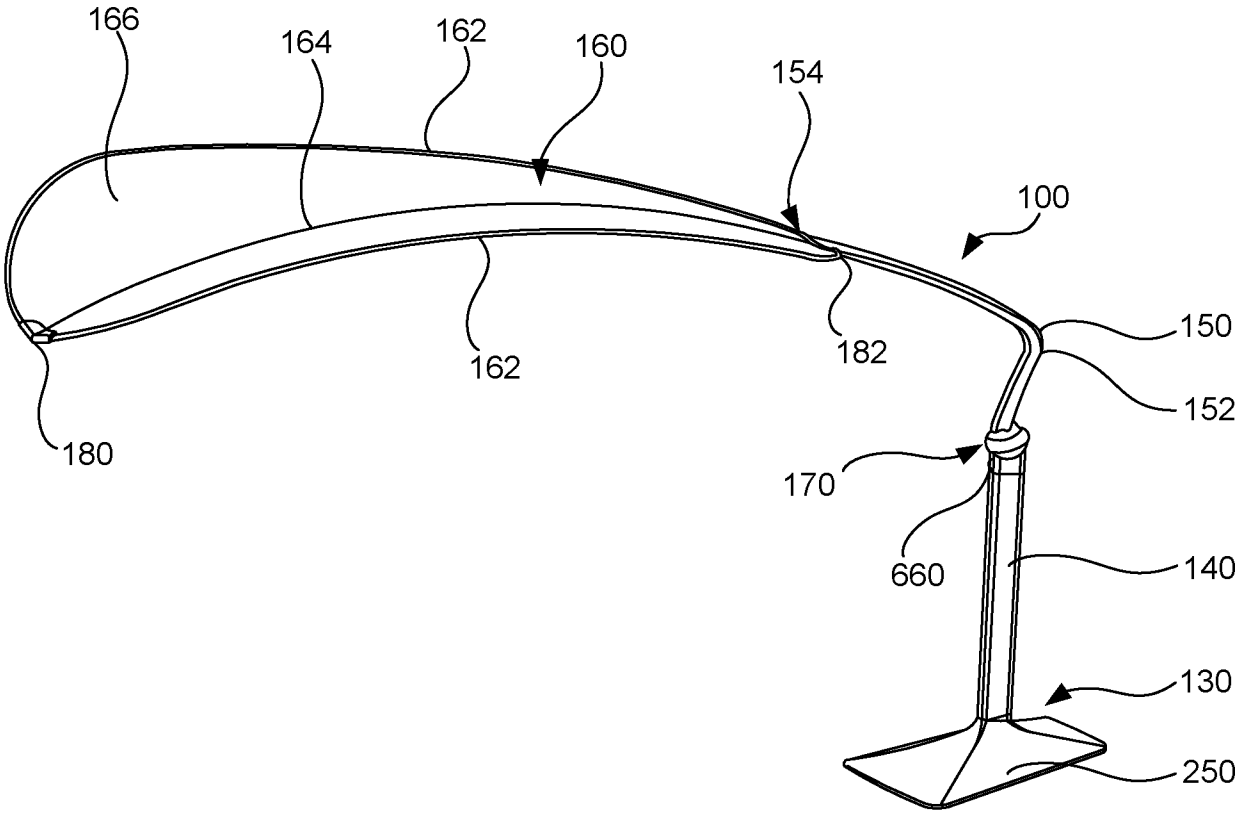
FIG. 2 is a perspective view of the canopy system of FIG. 1.
Figure 3:
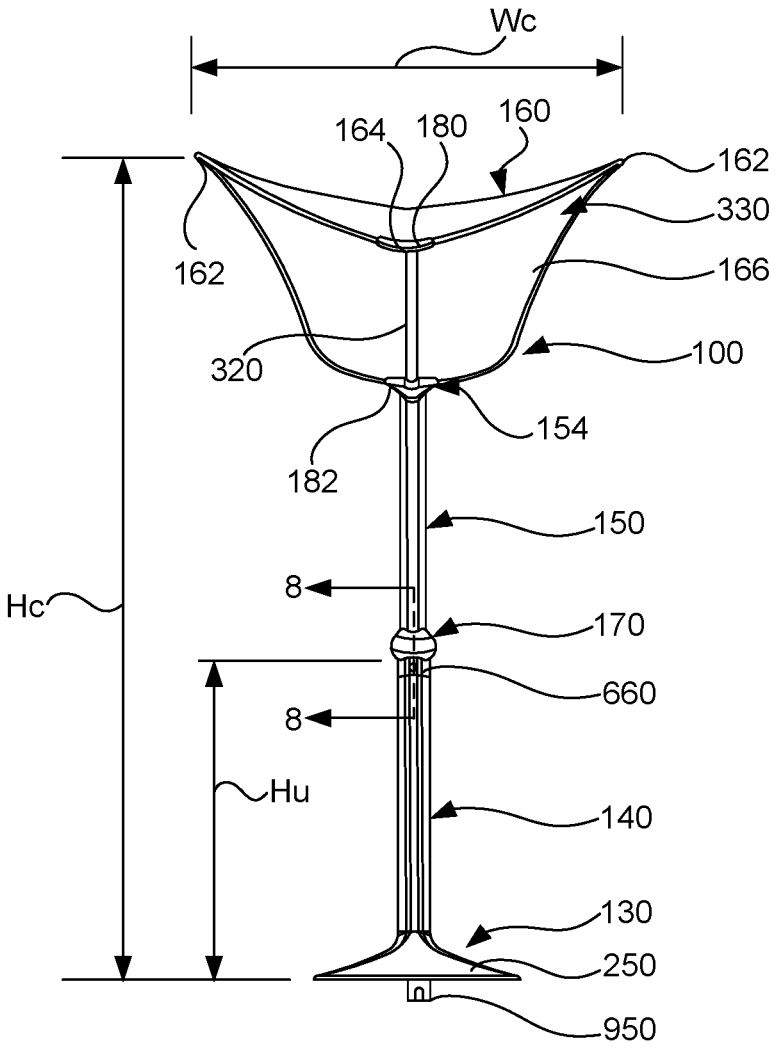
FIG. 3 is a frontal view of the canopy system of FIG. 1.
Figure 4:
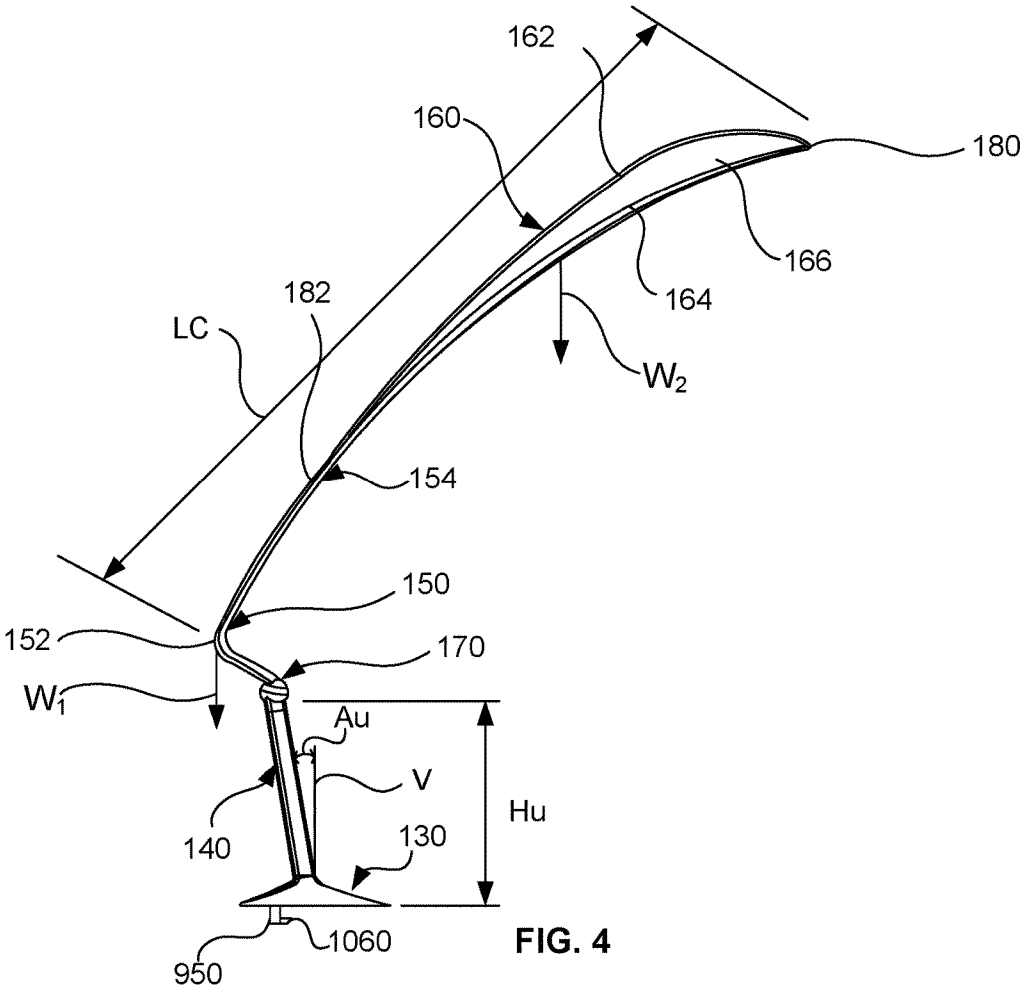
FIG. 4 is a side view of the canopy system of FIG. 1.

With further reference to FIGS. 2-4, the canopy system 100 consists of a base 130; upright 140 that extends upwardly from the base 130 at a predetermined rearward angle AU with respect to the vertical V (FIG. 4); arm assembly 150 that circumscribes a rearward curved (rearwardly curved segment) geometry for weight-counterbalance of the canopy element 160. A multi-dimensional joint 170 (the structure and function of which is described further below) positioned between the upright 140 and the arm assembly 150 allows for rotational motion (double curved arrows Rx, Ry and Rz) about three respective, orthogonal axes of rotation x, y and z. As described further below, the arm assembly 150 also includes a wrist joint 154 that allows for rotational motion (double curved arrow Rw) about an axis (AC in FIG. 5) taken along a direction of elongation of the canopy element 160.

The size of the canopy system 100 is highly variable. According to an aspect of the disclosure, the overall height HC of the system 100 (FIG. 3) is between approximately 30 and 76 in. The overall width WC of the canopy element 160 is between approximately 24 and 36 in. The height HU of the upright 140 is between approximately 18 and 24 in, and the length LC of the canopy element 160 is between approximately 48 and 60 in. Note that each of these dimensions is illustrative of a wide range of possible dimensions that can be varied to suit either the aesthetic and/or functional needs/desires of the user. In this example, the canopy element defines a symmetrical leaf-like shape with ovular side edges 162 and a ventral spine 164 that defines a V-shape in the depicted example. The side edges 162 and the spine 164 are formed using metal, composite (e.g. fiberglass or carbon fiber) and/or polymer rods of a predetermined diameter (e.g. ⅛-¼ inch) that are secured into a fabric surface 166 by appropriate seaming. The rods can be rigid or flexible, such as those known by those of skill for use in the construction of fabric kites. Thus, the rods can be bent into elastic deformation to hold their ovular shape against the perimeter of the fabric 166. As shown in FIG. 3, the rod 320 defining the ventral spine 164 is depicted as external of the fabric 166.

Figure 3A:
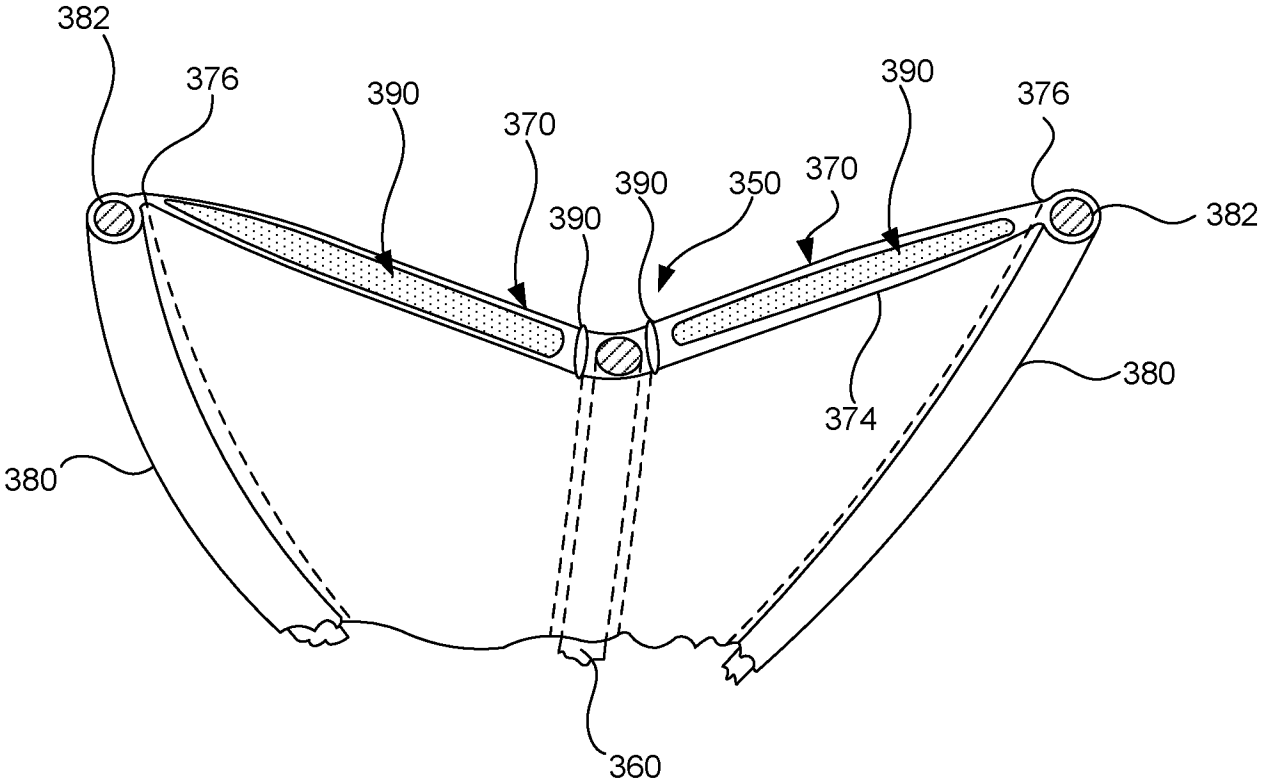
FIG. 3A is a partial frontal cross section of a canopy element according to an alternate example in which a spine rod is located internal of canopy fabric plies, and including an optional sound deadening layer located between fabric plies.

In alternate examples, such as that shown in the partial cross section of a canopy element 350 in FIG. 3A, the center rod 360 can be internal of the fabric portion 370, thereby accentuating the V-shape of the overall fabric between side edges 380. The depicted example includes two plies 372, 374 of fabric with a stitched (or welded) seam 376 to encapsulate the flexible edge rods 382 and a pair of seam 390 to (optionally) encapsulate the center rod 360. In this example, an optional, sandwiched layer of sound-deadening material 390 (e.g. foam, fiber fill, cork, gel, or any other cushioning/vibration-dampening substance) is located between the plies 372, 374. This layer can be applied to any of the examples (i.e. also those depicted with an external spine rod 320) as described herein. The sound deadening can be disposed between fabric plies, or can be an applied layer on the top an/or bottom of the canopy fabric (for example a layer of closed cell foam).

Note that the above-described arrangements/materials of rods, according to the examples of FIG. 3 and FIG. 3A, can be combined in various ways. For example, the rod arrangement can consist of fiberglass rods on each opposing edge (to provide tension to the fabric) and a stiff metal rod for use as the spine/central member. In this manner, the edge rods bend while the center remains straight—thereby providing a mechanism to define the particular shape of the overall canopy.

Referring also to FIG. 3, the underside 330 of the canopy element 160 can include a light-colored or reflective (i.e. specular) material (e.g. reflective Mylar®) to enhance the lighting effect beneath the user through reflection of ambient light onto the user and/or his/her workspace below. The rods of the spine 164 and side edges 162 are mounted at opposing ends in end caps 180 and 182 that can be constructed from polymer (e.g. ABS, PVC, Polycarbonate, etc.) of appropriate durability or another material, such as aluminum alloy. The fabric 166 can be any appropriate fabric, or a combination of fabrics in any desired color(s) and/or patterns. For example, a Polyester, Dacron, Nylon and/or wool woven (or knitted) fabric, or a non-woven sheet-like fabric, such as Mylar®, can be employed. In further embodiments, the "fabric" can be substituted for hard, semi-rigid or soft/pliable plastic that defines the desired canopy element (ovular, etc.) shape. Other materials, such as a thin wood/plywood/veneer and/or thin sheet metal (or a combination of such materials (e.g. a laminated structure). The pattern can include organization logos, colors or other significant design features. Notably, the canopy element, rods and end caps can be constructed to enable replacement of the fabric 166 for maintenance and/or aesthetic reasons by the user or others. This can entail removal of the front end cap 180 (and/or rear end cap 182), sliding off of the fabric from the rods, and threading on of a new fabric piece with subsequent replacement of the end cap(s). In an embodiment, the front end cap 180 can be polymer and the rear end cap 182 can be metal (e.g. aluminum alloy or zinc alloy) for strength and durability as part of the overall wrist joint 154.

Figure 5:
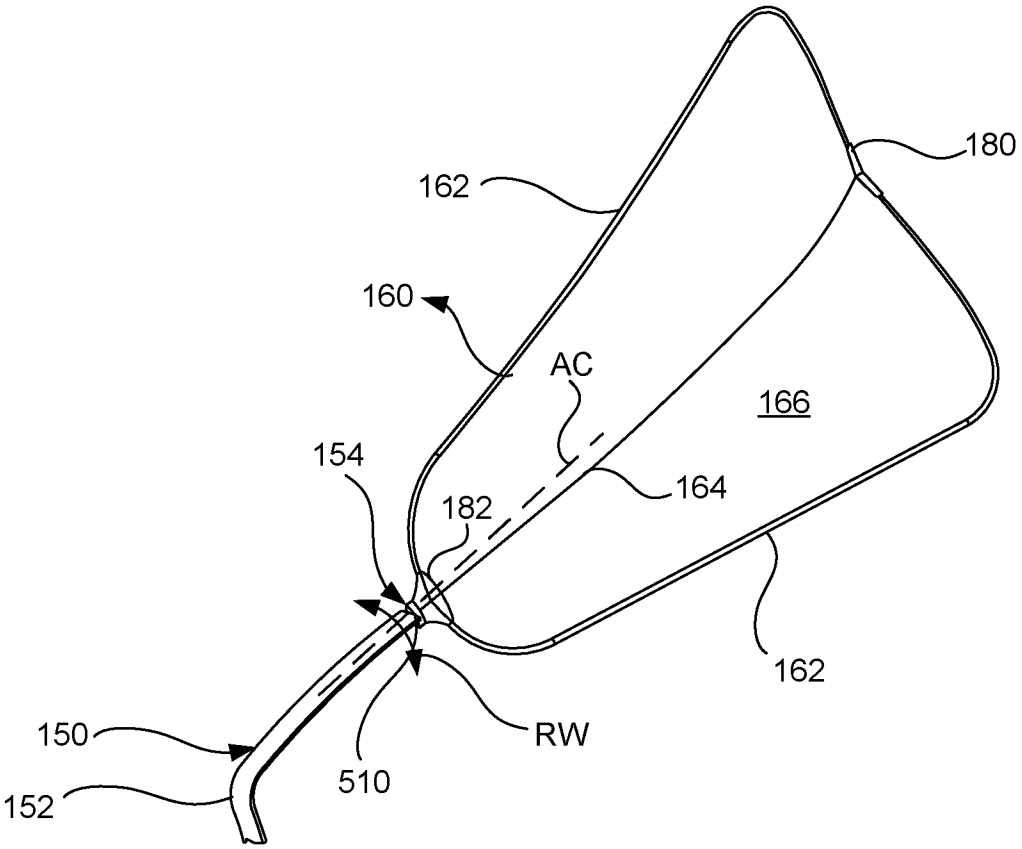
FIG. 5 is a fragmentary perspective view of the canopy system of FIG. 1 showing rotation of the wrist element to change the orientation of the canopy element.

The upright 140 can be constructed from any appropriate material, such as polymer, composite (e.g. fiberglass, carbon fiber, glass-filled nylon), or metal (e.g. aluminum alloy, steel alloy or zinc alloy). Likewise, the arm assembly 150 can be constructed from similar materials. With reference to FIG. 5, the end cap 182 that confronts the arm assembly is part of the wrist joint 154 described above. The end cap 182 is joined to the confronting end 510 of the arm assembly 150 using an axle assembly in which the end cap 182 can rotate (double curved arrow Rw) about the canopy elongation axis AC with respect to the arm assembly 150. The axle assembly can include an optional locking assembly (not shown), such as a spring-loaded catch assembly, set screw assembly, or the like, or it can generate friction so that rotation of the canopy element 160 with respect to the arm assembly 150 remains relatively fixed once rotated into a desired position. More generally, the canopy can be rotated by the user to assume a desired tilt.

Figure 6:
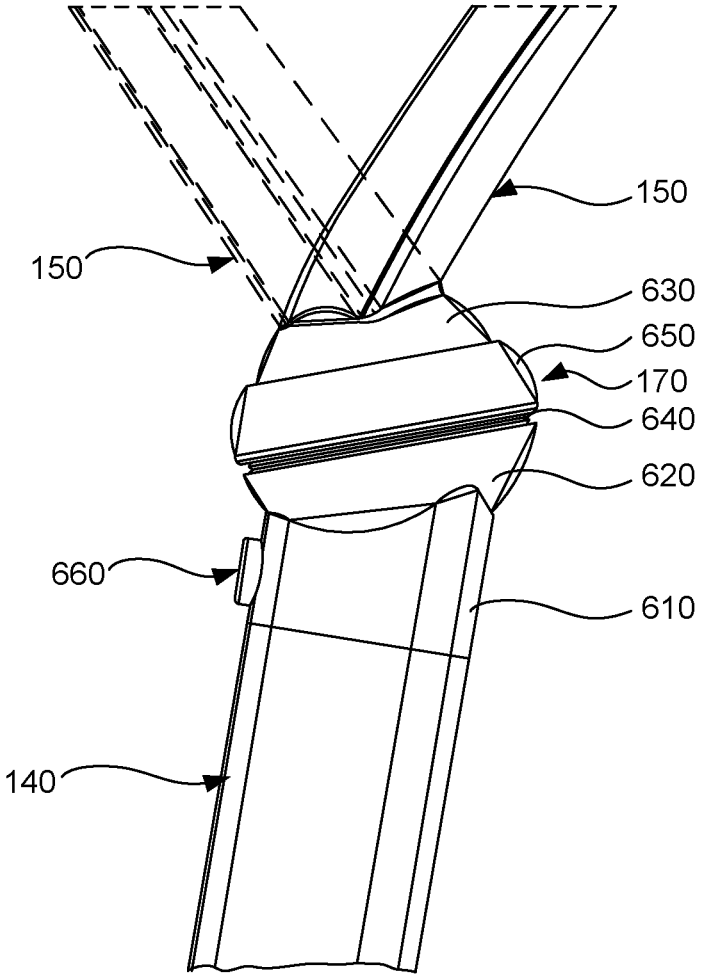
FIG. 6 is a fragmentary side view of a multi-dimensional joint in the ball-and-socket joint between the upright and the arm assembly that supports the canopy element.
Figure 7:
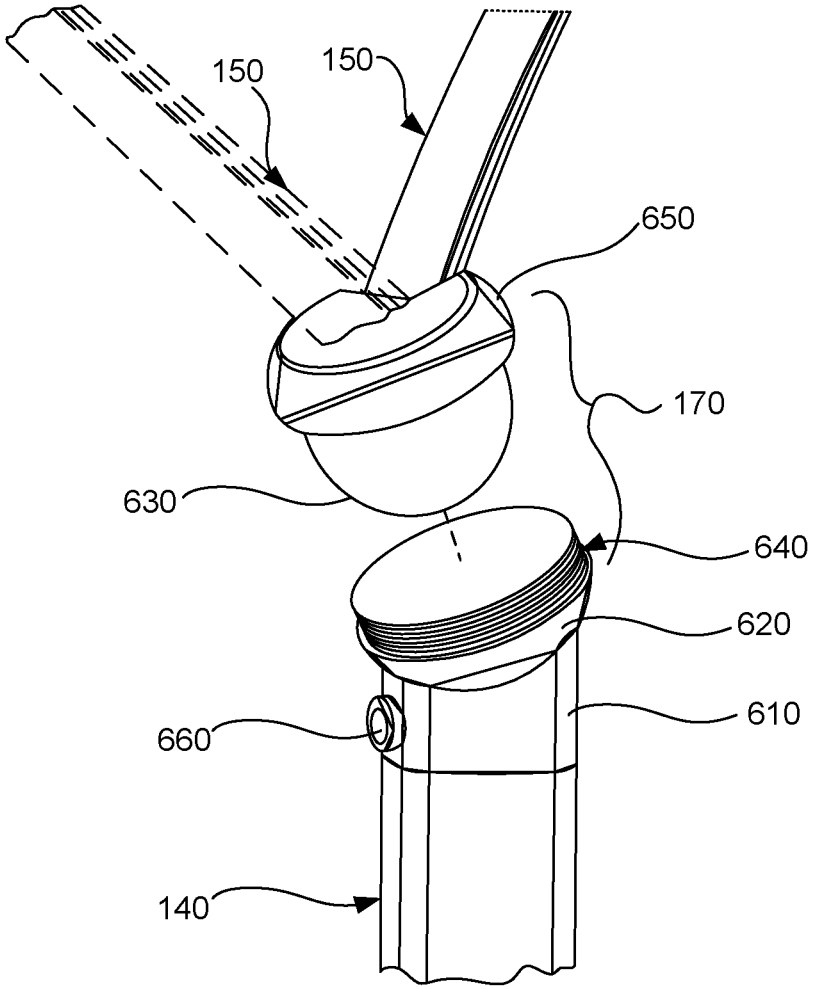
FIG. 7 is an exploded fragmentary view of the ball-and-socket joint of FIG. 6.

As described above, the multi-dimensional joint 170 allows the arm assembly 150 to rotate in three degrees of freedom as shown in FIG. 1. This is accomplished using a ball-and-socket configuration according to an aspect of the disclosure. In the depicted example, and with reference particularly to FIGS. 6-8, the joint 170 includes a socket element 610 that is secured into a recess 810 the top end of the upright 140 by set screws 820 or another appropriate fastening arrangement. The socket element 610 includes a hemispherical socket 620 that receives a spherical ball element 630 located at the bottom end of the arm assembly 150. The socket 620 includes external threads 640 arranged to receive internal threads 820 on a socket cap 650. When threaded together, the socket cap 650 retains the ball 630 against the socket in a closely conforming engagement.

Figure 8:
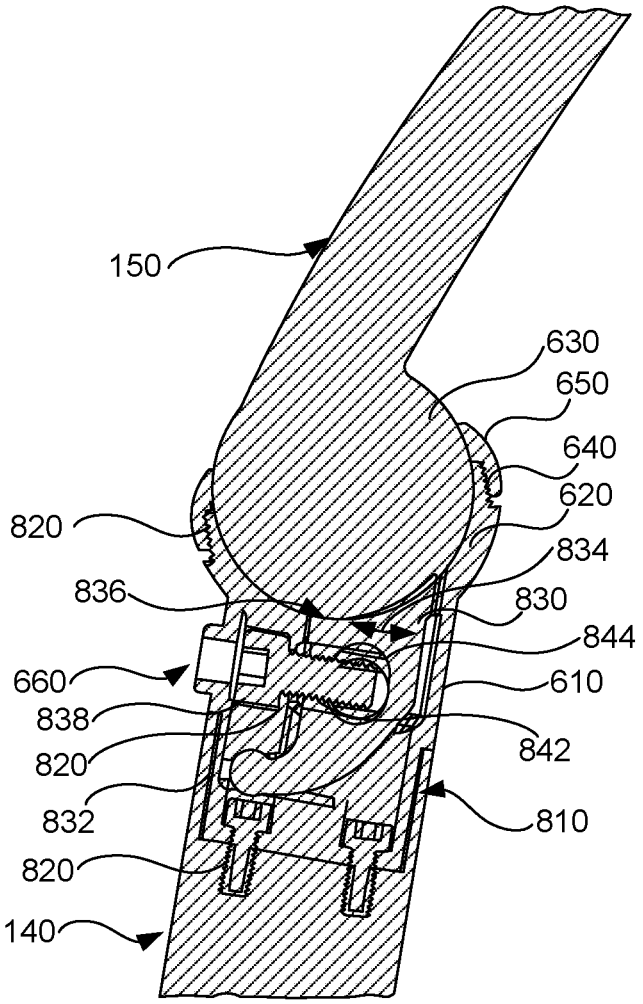
FIG. 8 is a fragmentary cross section of the ball-and-socket joint of FIG. 6, taken along line 8-8 of FIG. 3.

The arm assembly ball 630 is fixed in position relative to the socket 620 on the upright by a pivoting brake member 830 (FIG. 8). The brake member 830 is pivotally mounted, via a bottom pivot end 832, to a recess formed within the socket element 610. The brake member 830 pivots to move (double arrow 834) a hemispherical (or otherwise curved) top surface 836 into and out of pressurable engagement with the bottom of the ball 630. Pressure is applied and released by a set screw 838 having a head that engages a rim 840 on the socket element 610 and external threads 842 that seat within conforming internal threads 844 on the brake member 830. The screw can employ any acceptable drive head geometry (e.g. hex, Torx®, square, etc.). The drive head is accessed through a port 660 through which an appropriate drive member can be inserted. Rotating the set screw causes the brake member to move selectively into or out of pressurable engagement with the ball. Thus, in operation, a user moves the arm assembly 150 relative to the upright 140 in each of three degrees of rotational freedom to a desired orientation while the brake member 830 is disengaged, and then tightens the set screw 838 to secure the arm assembly 150 in the desired orientation. The socket cap 650, brake member and socket element 610 can be constructed from a variety of materials including, but not limited to, hard plastic (e.g. Delrin®, polycarbonate), metal (e.g. aluminum and zinc alloy), and composite.

It is expressly contemplated that separate joints can be used to achieve rotation along one or more respective degrees of freedom. For example, the upright can be adapted to pivot about the base to achieve rotation about the z axis, with pivot axles along the length of the upright and/or arm assembly providing x-axis and/or y-axis rotation. For the term joint arrangement can include a multi-dimensional joint, such as the ball and socket described herein, or a series of pivoting joints operating remote from each other or a gimbal system (a version of which is described below).

With particular reference to FIG. 4, the rearwardly curved segment 152 of the arm assembly 150 serves not only an aesthetic purpose, but also assists in balancing the weight of the overall movable portion of the canopy system 100. As shown, the weight W2 of the canopy system is transferred, in part, rearwardly as weight W1 in the segment 152. Thus part of the overall weight is placed on an opposing side of the joint 170. This partly or fully relieves excess torque on the joint and enables use of reduced application of braking force by the brake member 830. More generally, the counterbalancing of overall weight using a rearward curve of the arm assembly can enable the weight distribution of the system 100 to be sufficiently balanced so that it is freestanding (without/free-of the used of a base clamp). The base can include sufficient weight and define a sufficient footprint to stabilize a freestanding version of the system. In alternate arrangements a counterweight can be added to the rearwardly located portion of the arm assembly.

Figure 9:
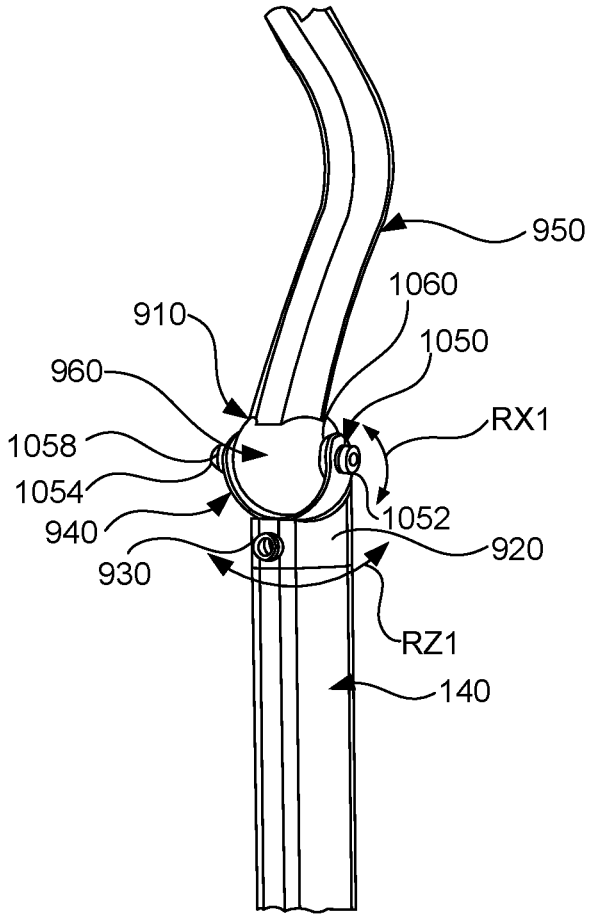
FIG. 9 is a fragmentary perspective view of a multi-dimensional joint according to another example, comprising a modified ball-and-socket joint with a pivot axle for two rotational degrees of freedom.
Figure 10:
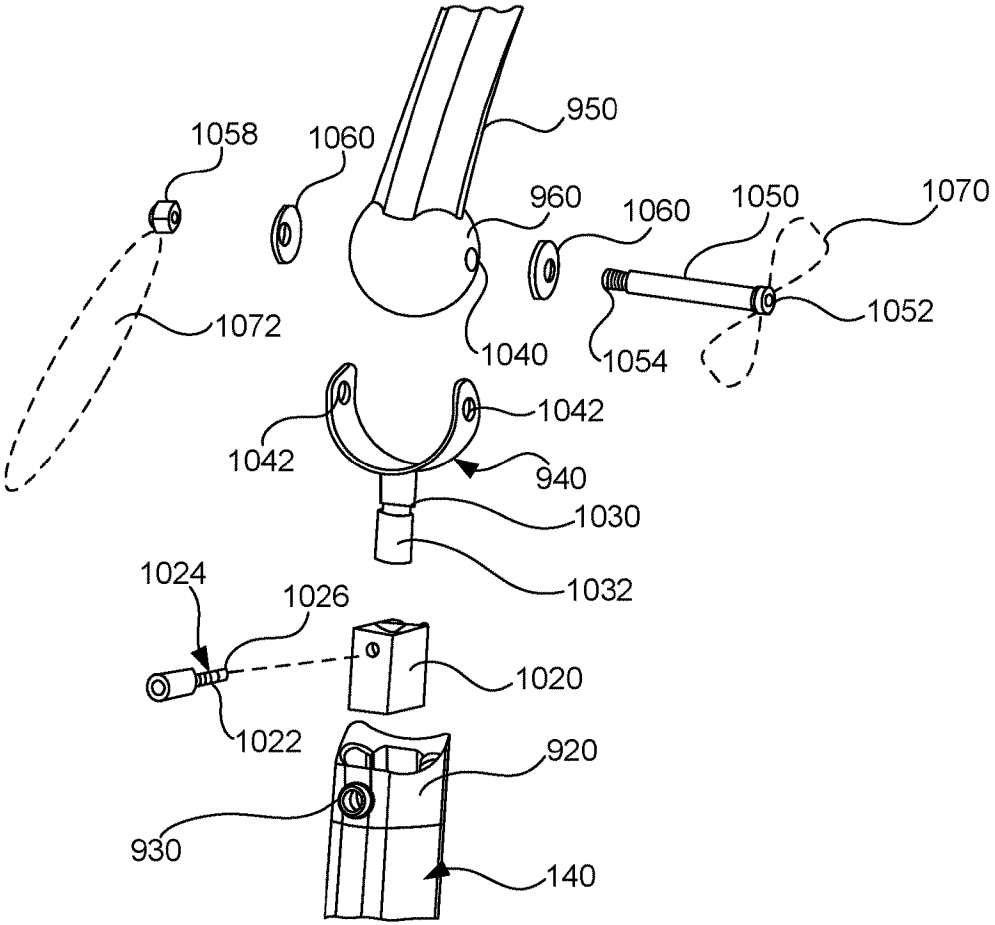
FIG. 10 is a fragmentary exploded view of the multi-dimensional joint of FIG. 9.

FIGS. 9 and 10 depict a multi-dimensional joint 910 according to an alternate example. For the purposes of the description, the joint 910 can be provided to the canopy system 100 in accordance with the example depicted in FIGS. 1-5 in substitution for the ball-and-socket joint arrangement 170. According to an aspect of the disclosure, the joint 910 is mounted on the upright 140 (as previously described above), with a receiving element 920 that includes an internal locking block 1020 with a threaded hole 1022 for receiving a set screw 1024 that can be accessed for tightening/untightening through the port 930 in the element 920. The tip of the screw shaft 1026 selectively engages an annular grove 1032 in the shaft 1030 of a yoke assembly 940. The yoke shaft 1032 can pivot (double-curved arrow Rz1) when not locked by the screw 1024 about the z axis (also termed the "right and left" direction). The yoke 940 engages a ball 960 mounted at the end of the arm assembly 950. In this example, the arm assembly 950 is similar in shape and size (as well as connection to the canopy element) to the above-described arm assembly 150 referred to in the example of FIGS. 1-5. While a ball 960 is shown and described in this example, another shape—e.g. a cylinder—can be employed at the end of the arm assembly 950 in alternate arrangements. A through-hole 1040 through the center of the ball 960, along with holes 1042 through each end of the yoke 940, collectively receive a pivot axle 1050 with an exemplary drive head 1052 and opposing external thread 1054. The pivot 1050 allows the arm assembly 950 to pivot (double-curved arrow Rx1) about the x rotational axis. The pivot is secured by a nut 1058. A pair of washers 1060 can allow for friction reduction between the yoke 940 and ball 960 and/or can be constructed from a material that generates holding friction between these elements (e.g. an elastomeric washer or one with a textured surface) when the nut 1058 and head 1052 are driven into compression. In further examples, either (or both) the pivot drive head 1052 and/or the nut 1058 can be replaced with a winged head 1070 and/or a lever handle 1072 (as shown in phantom) to assist the user in adjusting compression on the joint assembly 910. It should be clear that a variety mechanisms can be used to secure the arm assembly against rotation relative to the yoke according to aspects of the disclosure. As a further alternative, the screw 1024 can cause a portion of the locking block 1020 to pivot into engagement with the surface of the ball 1060 so as to retain the ball in the predetermined orientation selected by the user.

This particular joint arrangement (910) allows for rotation on two discrete axes, rather than the free rotation in three degrees enabled by the ball-and-socket joint 170 in the example of FIGS. 1-5. The above-described wrist joint (154) on the arm assembly 950 allows for tilt of the canopy element, thereby providing three discrete degrees of rotational freedom to the system.

Notably, the joint assembly 910 of FIGS. 9 and 10 allows for application of a strong braking/retaining force in rotation Rx1 about the x axis (also termed the "up and down" direction) by tightening the screw pivot head 1052 and opposing nut 1058, as motion in this direction is often heavily biased by the weight of the canopy element and arm assembly. However, the joint 910 enables application of light or no braking force about the z axis (Rz1) or at the wrist joint. Thus, the canopy element is securely held up, but can still be tilted and/or moved side-to-side by the user with a light force.

Figure 11:
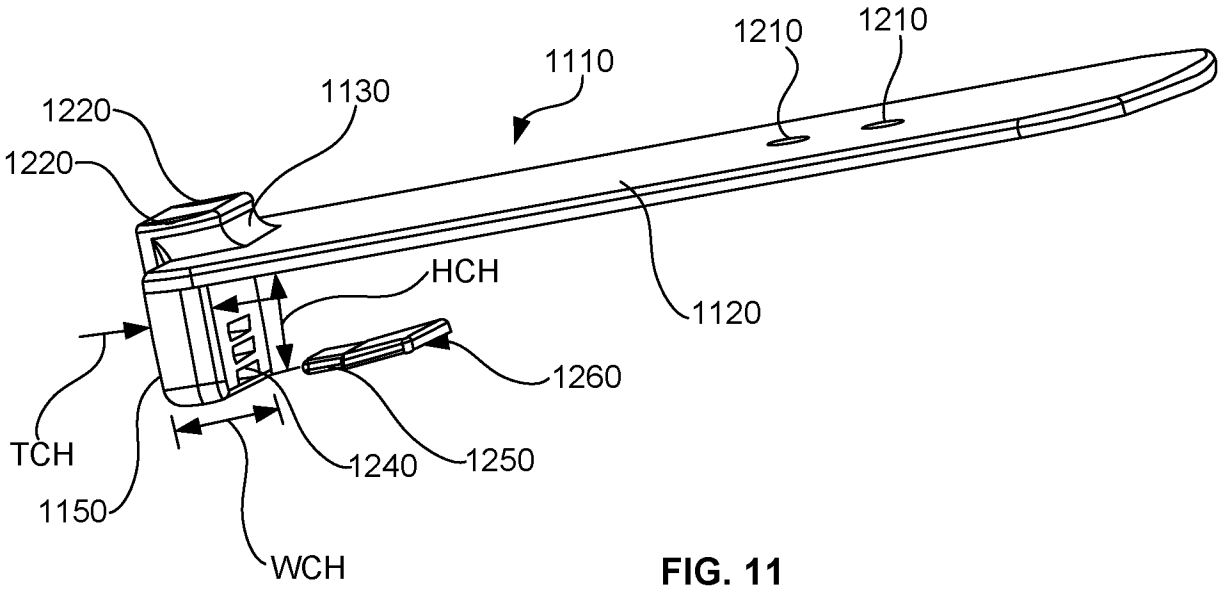
FIG. 11 is a bottom-oriented perspective view of the clamping arrangement for the upright base of the canopy system of FIG. 1.
Figure 12:
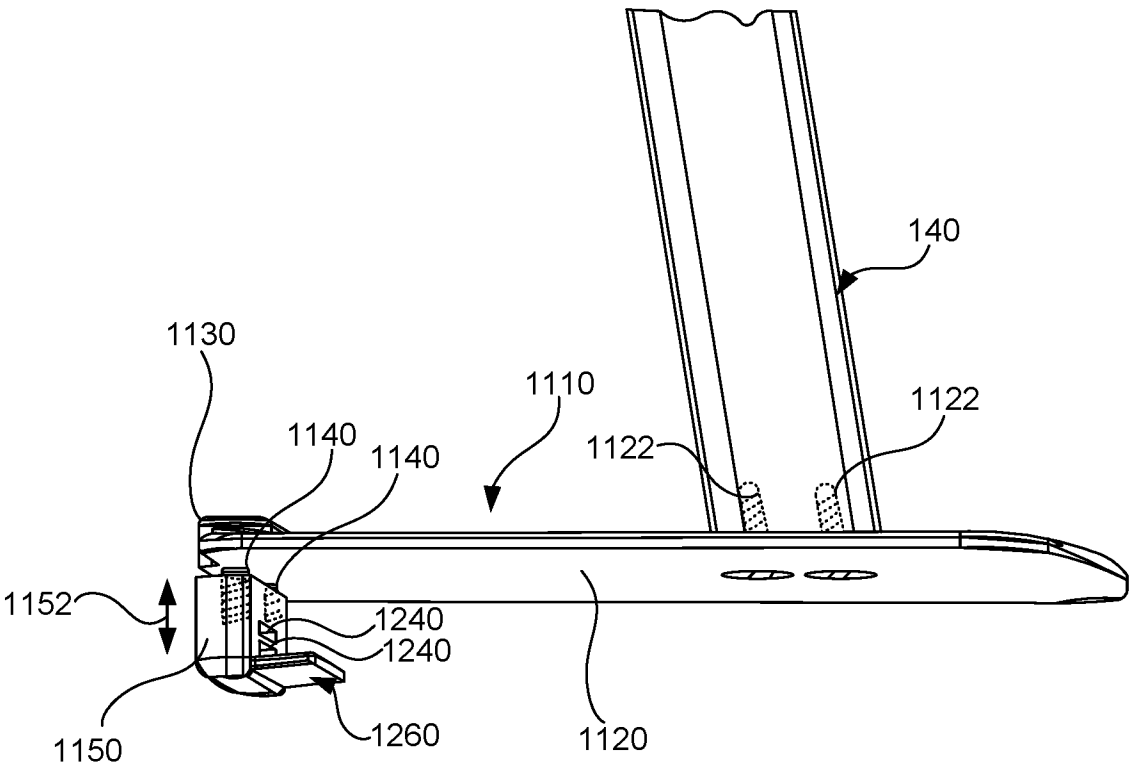
FIG. 12 is a side-oriented perspective view of the clamping arrangement of FIG. 11 showing an adjustable clamp element for pressurably engaging the bottom of desktop surfaces of various thicknesses.

Reference is now made to FIGS. 11 and 12, which show an adjustable clamping arrangement 1110 that can be adjusted to engage a range of desktop thicknesses, where the arrangement according to any example herein is mounted in a clamped (as opposed to freestanding) arrangement. The clamping arrangement typically resides beneath a movable (e.g. slidable along the upright 140) cover 250 (FIG. 2) on the base 130. The clamping arrangement 1110 includes a base plate 1120 with a pair of through-holes 1210 that are sized and arranged to receive set screws 1122 (partially shown in phantom) that are threaded into the bottom of the upright 140. The base plate 1120 is constructed from metal (e.g. steel or aluminum alloy) or a solid polymer/composite. The rear end of the base plate 1120 includes a clamp base 1130 adapted to receive a pair of set screws 1140. The drive heads 1220 of the set screws 1140 are seated in the clamp base 1130 and their threaded shafts extend downwardly to engage internal threads (shown in phantom) in a clamp head 1150. The clamp head 1150 can, thus, be moved upwardly and downwardly (double arrow 1152) by turning the set screws 1140 via the drive heads 1220. The height HCH of the clamp head can be between approximately 0.75 and 2.5 inches, and depends in part upon the maximum thickness of desktop to be engaged. The clamp head width WCH can be between approximately 2.0 and 4.0 inches, and the thickness TCH can be between approximately 0.5 and 1.0 inches. These dimensions are based in part upon the size of grommet of shot through which the clamp head is to be inserted on the desktop. Notably, the clamp head 1150 includes (e.g.) three slots 1240 along its front face at various height intervals (e.g. approximately 0.25 inch spacing apart). These slots are arranged to receive the front tab 1250 of a clamp plate 1260. The clamp plate 1260 is adapted to engage the bottom of the desktop under pressure applied by the set screws 1140 to secure the canopy system base plate 1120 to the desktop. The clamp plate 1260 can be moved between the slots to provide the best rough position that accommodates the relative thickness of desktop. Then, the screws 1140 are tightened to clamp the arrangement 1110 securely. Notably, the tab 1250 is angled slightly (about 2-5 degrees) relative to the overall clamp plate 1260 so that, when inserted in the slot 1240, the exposed clamp plate is slightly upturned. This ensures that the plate will slightly dig into to bottom of the desktop for a more secure clamping engagement. The clamp plate 1260 can be constructed from a durable material such as steel alloy. The clamp head can be constructed from metal (e.g. steel or aluminum alloy), polymer or composite. Likewise the base plate 1120 is typically constructed from metal (e.g. steel or aluminum alloy) or a durable polymer/composite.

While not shown, it is contemplated that the base of the canopy system can be adapted to include various optional attachments that facilitate its attachment to other surfaces—for example vertical surfaces. By way of non-limiting example, the canopy system base can include a plug that conforms to the shape of a tubular post. Likewise, the base can include a clamp that is sized and arranged to mount on the top edge of a cubicle wall. The clamp described above can also mount to a suspended shelf on a cubicle wall. Likewise, the base can include conforming shelf-bracket hooks so that it can be employed in the same manner as a movable shelf bracket system that is integrated with a cubicle wall, or separately mounted on a room wall. The shape, size and balanced weighting of the canopy system advantageously lend themselves to each of these potential mounting arrangements and/or deployments.

II. Adjustable Shade

Figure 13:
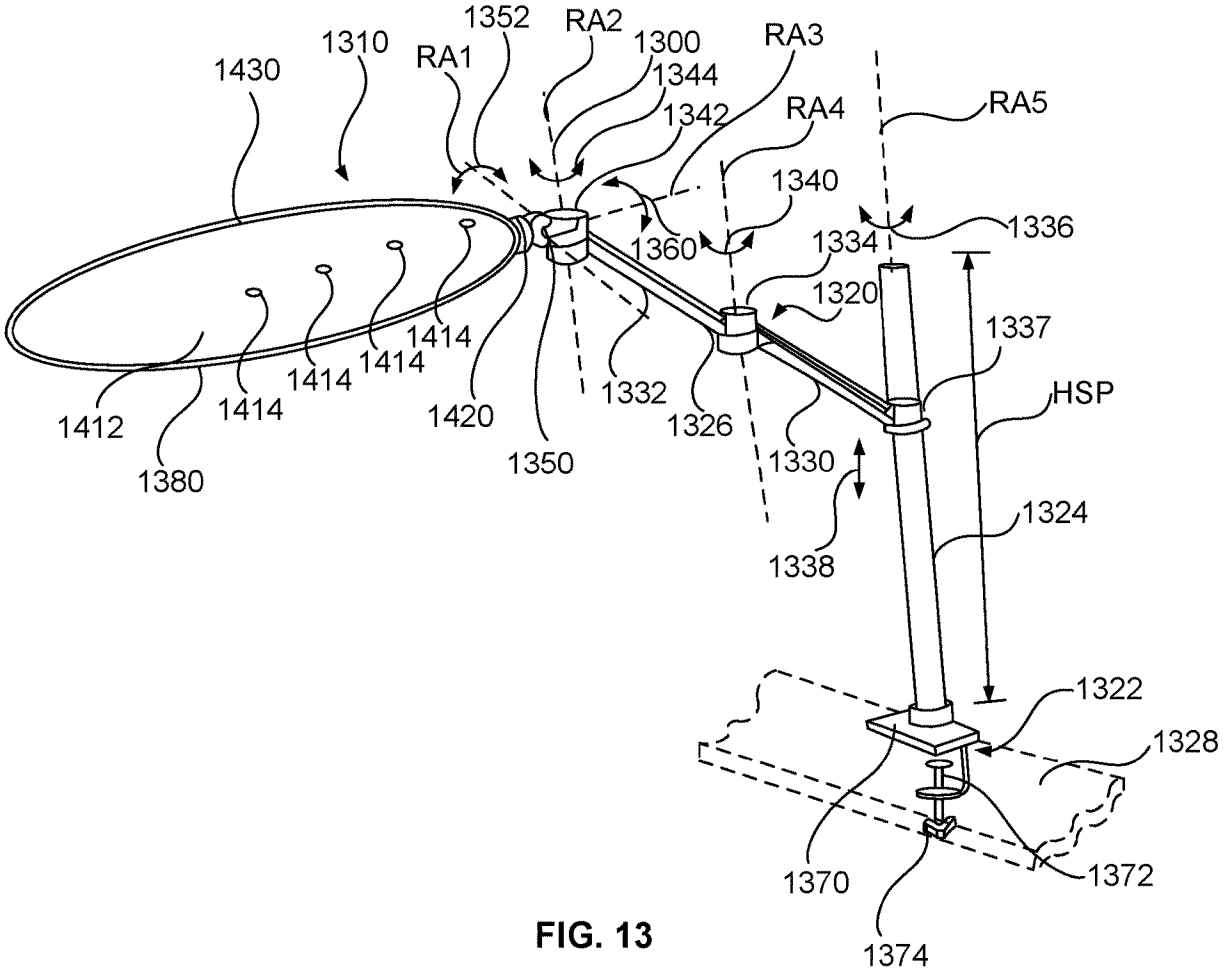
FIG. 13 is a perspective view of an adjustable personal shade and support assembly for a desktop of a workplace according to an illustrative embodiment.

FIG. 13 shows a shade arrangement 1300 that can be used to deflect and block light, protect against air drafts and provide privacy to a discrete user seated at a desk in a manner generally described above. The arrangement 1300 consists of a shade assembly 1310 and a support assembly 1320. The support assembly 1320 is (or is based upon) a conventional (e.g. VESA) monitor support that includes a clamp assembly 1322 that engages a desktop edge (or wire port within a desktop 1328—shown in phantom); an upright, cylindrical post 1324 that defines a height HSP of between approximately 24 and 30 inches in an illustrative embodiment (along a central axis of elongation RA5; and a multi-axis arm arrangement 1326. As described further below, the depicted support assembly is a particular type of (VESA) computer monitor mount is one of a wide variety of mechanisms and types of mounts and the shade assembly herein can advantageously be mounted on any type of computer monitor/television (or similar) mount. Thus, the support assembly (mount) can be a ceiling or wall mount, permanent or removable mount, and can include a variety of adjustment mechanisms. Based on the chosen support assembly/mount, the height of the shade is highly variable and can be as high as 6.5 feet in an embodiment. The depicted support assembly/mount is described herein by way of non-limiting example to illustrate the broader principles of adjustability for the shade assembly 1310 according to this embodiment. For the illustrative (exemplary) support assembly/mount 1320, the arm arrangement 1326 includes two upwardly angled/inclined lower and upper arm members 1330 and 1332, respectively, with a rotation knuckle/joint 1334 therebetween defining a rotational axis RA4 (which (e.g. is parallel to post axis RA5). The lower arm member 1330 is rotationally and adjustably fixed to the post 1324 using a mounting ring 1331, and can be locked in a desired rotation (double-curved arrow 1336) about the post 1324 and at a desired height (double-arrow 1338) along the post by an appropriate locking mechanism (e.g. a clamp, set, screw/knob, etc.). The knuckle/joint 1334 between lower and upper arm members 1330, 1332 also allows rotation (double-curved arrow 1340) about the axis RA4. The distal end of the upper arm member 1332 includes another knuckle/joint 1342 that defines a rotational axis RA2, (e.g.) parallel to axes RA5 and RA4, allowing associated rotation (double-curved arrow 1344) about the axis RA2. Collectively, rotation about axes RA5, RA4 and RA2 enables the arm arrangement to move laterally (in multi-axis yaw) in two degrees of freedom so as to control the position of the shade assembly 1310.

The distal joint/knuckle 1342 on the upper arm member 1332 connects to a transverse joint/knuckle 1350 that allows rotation (double-curved arrow 1352) along an orthogonal axis RA1. This enables the pitch of the shade assembly 1310 to be varied to suit the user. In various embodiments, the rotation of the joint 1350 can be locked using a clamp, set screw and/or other friction-generating components that should be clear to those of skill. This prevents the selected tilt/pitch from varying due to the force of gravity. Note that the knuckles/joints 1334 and 1342 can be locked (using an appropriate mechanism), or allowed to move freely (or provided with predetermined, frictional resistance), as their motion is oriented transverse to the acting direction of gravity (with axes generally aligned with the action direction of gravity), wherein their position remains relatively fixed when set by the user, and free of drift.

Figure 14:
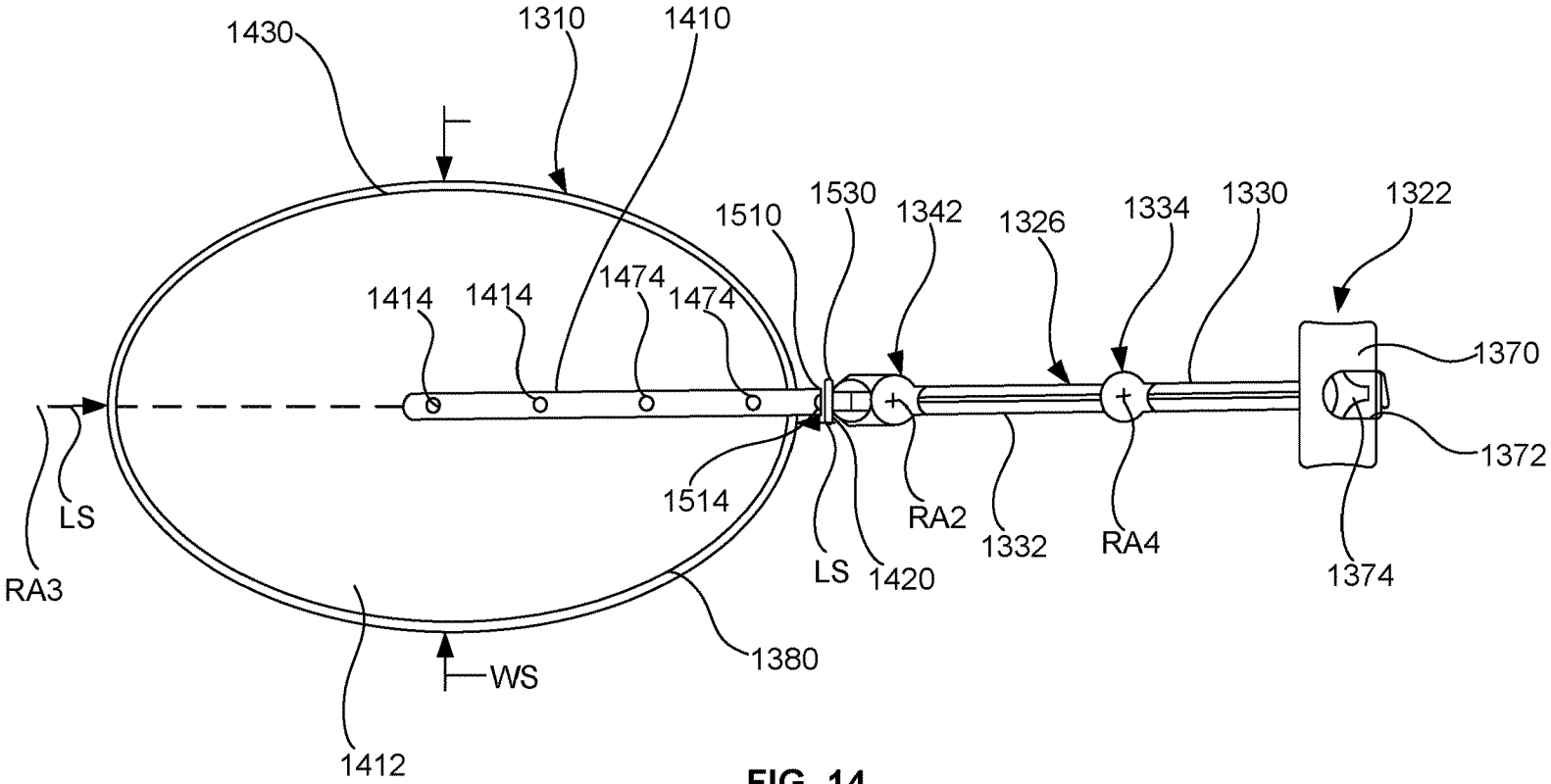
FIG. 14 is a bottom view of the shade and support assembly of FIG. 13 showing a centrally mounted supporting frame in the form of a rib or bar.
Figure 15:
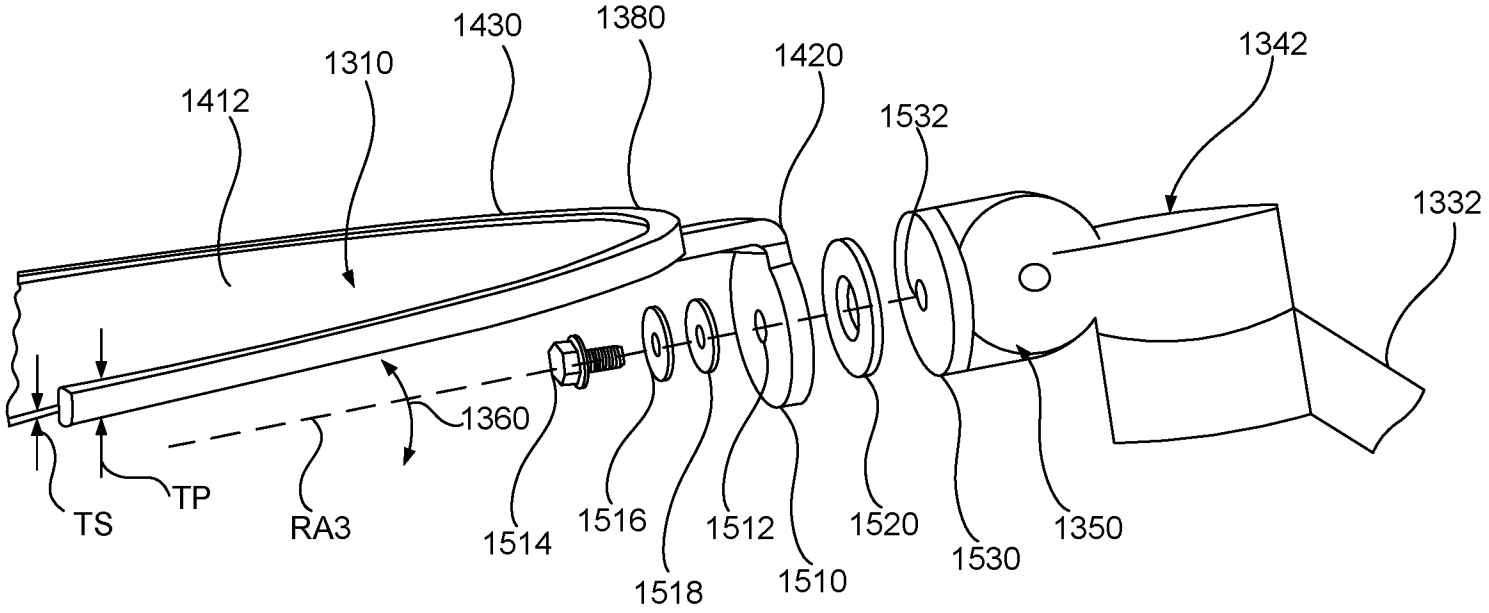
FIG. 15 is a more detailed, exploded perspective view of the mounting base assembly of the shade of FIG. 13.

Referring also to FIG. 14, the shade assembly 1310 of is attached to the upper arm member 1332 by a supporting frame in the form of a rib or bar 1410 that extends partially along a centerline (i.e. axis RA3) of the shade. The bar in this embodiment is attached to the shade material 1412, which is a semi-rigid polymer sheet described further below. The bar 1410 is secured to the shade material 1412 by fasteners (e.g. screws 1414) that pass through the material and can be secured into the bar 1410. A variety of materials, such as aluminum allow or polymer can be use to construct the bar 1410. Illustratively, the bar 1410 extends approximately 60 percent of the overall length LS (FIG. 14) of the shade assembly 1310 so as to provide sufficient support and rigidity to the structure. The proximal end of the bar 1410 defines a base 1420 that projects rearwardly from the perimeter 1430 of the shade 1310. With further reference to FIG. 15, the base 1420 in this embodiment defines an annular member 1510 with a central hole 1512 that receives a screw or other threaded fastener (e.g. a wing bolt) 1514. The screw 1514 passes through a standard washer and a polymer washer (e.g. nylon). The annular member 1510 engages a larger polymer washer 1520 that provides friction between the member and the opposing face 1530 of the joint 1350. The face 1530 includes a threaded hole 1532 to receive the screw. When in compression, the tilt/roll of the shade assembly 1310 is fixed by the friction generated between the components (1510, 1520 and 1530) by the tightened screw. When the screw 1514 is loosened, and compression relieved, the shade and associated base 1420 can rotate (double-curved arrow 1360) along the roll axis RA3. Note that a variety of clamping and/or securing mechanisms can fix the shade in a desired rotational position. These clamping and/or securing mechanisms can be hand-operated (using e.g. a lever, knob, or winged assembly), or actuated with an associated tool (e.g. a hex wrench or screwdriver). One or both of the faces of the confronting components 1510, 1530 can be textured or otherwise modified to enhance grip and friction when the screw is tightened. In general, the material of the washer 1520 is adapted to provide desired holding friction.

The clamp assembly 1322 is one of a variety of possible arrangements for securing the upright support tube 1324 to the desktop 1328. The depicted clamp assembly includes a top plate 1370 that engages the top surface of the desktop 1328 and an opposing bottom bracket 1372 that faces (and is generally spaced-apart from) the bottom surface of the desktop 1328. The bottom bracket is threaded to receive a clamping screw assembly 1374 that applies compression between the bottom bracket 1372 and the top plate 1370 to pressurably (and removably) secure the clamping assembly 1322 in place. As described a variety of alternate removable and permanent mounting structures can be employed in alternate embodiments, which include flanges with holes to receive fasteners (e.g. screws), tape and/or adhesive-secured bases, etc.

Also, while the above-described support assembly 1320 is shown with the specified joint/knuckle arrangement, other arrangements and numbers of joints, rotational, axes, support heights, and arm lengths are expressly contemplated in alternate embodiments. Likewise, in various embodiments, some or all of the components of the support assembly can be provided by flexible shafts (e.g. a segmented gooseneck arrangement) that can be twisted along one or more degrees of freedom into a desired shape. Such shafts maintain their shape unless applied force of a certain level is used to move the shaft to a new position.

The shade 1310 includes a raised perimeter 1380 that can be molded with the interior shade material 1412 and provides a strengthening rib to the overall structure. Alternatively, the perimeter can be a separate frame into which the shade material is mounted. The thickness TP (FIG. 15) of the perimeter 1430 can be between approximately 0.2 and 0.4 inches, although thicker or thinner perimeters can be employed in alternate embodiments. In various embodiments, the width WS (the minor axis of the oval) of the shade assembly 1310 is between approximately 12 and 30 inches, and the length LS (the major axis of the oval) can be between approximately 22 inches and 42 inches (although the width and/or length can be larger or smaller in alternate embodiments). The thickness TS (FIG. 15) of the shade material can be between approximately 0.05 and 0.25 inches in various embodiments, although a thicker or thinner dimension can be employed in alternate embodiments.

The material 1412 of the shade is highly variable. In an illustrative embodiment, the shade material 1412 is a polycarbonate or acrylic polymer (plastic). The shade can be opaque, transparent or translucent—for example having a frosted finish on one or both sides. The color or tint of the material is highly variable. In various embodiments it can be frosted-transparent and thereby gently diffuse incident light (ambient office lighting, sunlight, purpose-built illumination, etc.) into a variety of colors and create a subtle color hue at the desktop. By providing a non-clear/non-white tint (e.g. pink, green, yellow, blue, orange, violet, white, black (i.e. light-blocking), various shades of gray (i.e. light-dimming), etc.), the shade can compensate for undesirable ambient lighting hues and/or provide a therapeutic lighting hue to the user. Studies indicate that certain lighting hues can affect a user's mood, well-being and even health. In an office environment, such hues can increase efficiency and productivity and reduce fatigue. The shade material also inherently protects the user from over 90% of harmful UV rays and can be supplemented with coatings that block larger percentages of such harmful rays.

Figure 16:
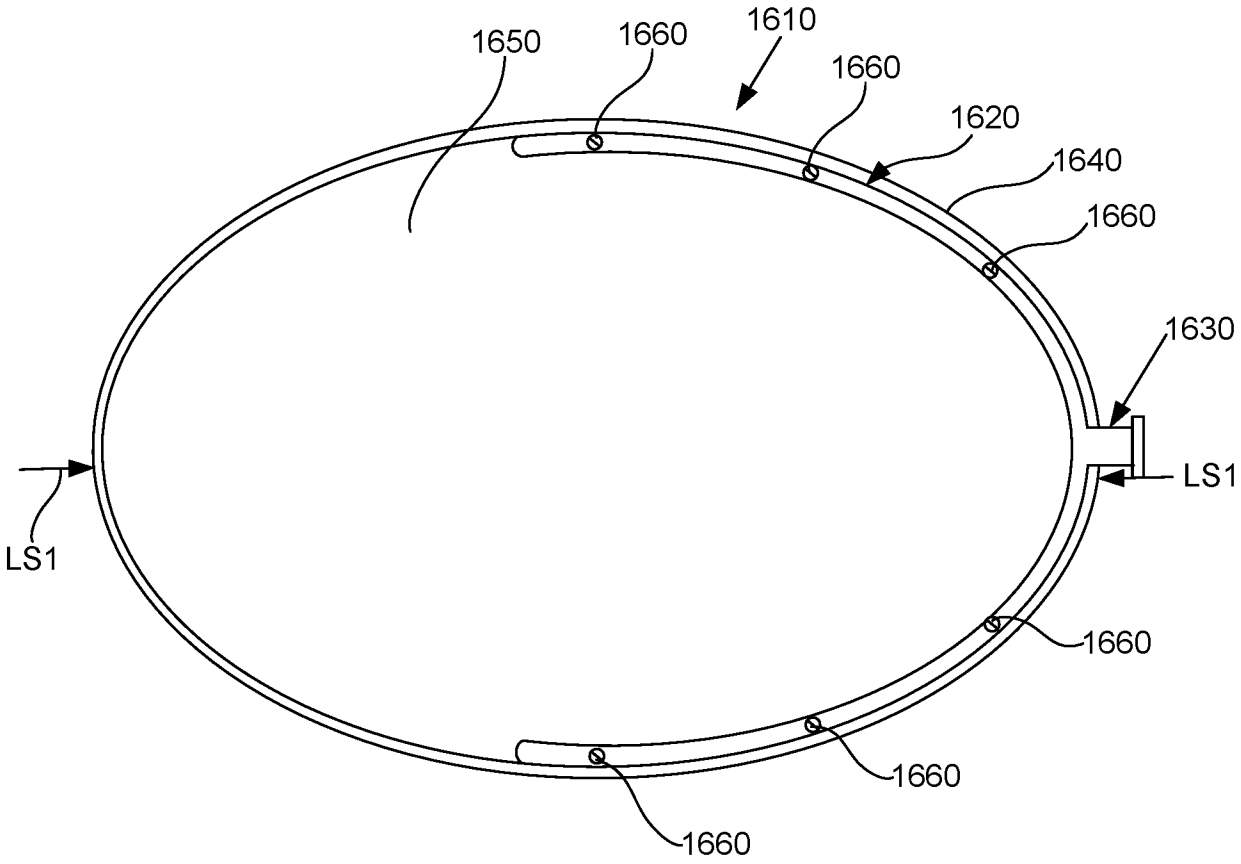
FIG. 16 is a bottom view of an adjustable personal shade according to an alternate embodiment including a supporting frame that is that is arranged around apportion of the perimeter of the shade in the form of a horseshoe shape.

Reference is now made to FIG. 16, which shows a shade assembly 1610 having the above-described oval shape. The supporting frame 1620 in this embodiment defines a "horseshoe" or semi-oval shape as shown that extends from a unitary base 1630 (having a similar shape and function to the base 1420 described above), around each side of the raised perimeter edge 1640 in engagement with the sheet material 1650. The frame 1620 is secured to the material using fasteners (e.g. screws 1660) and/or another securing mechanism as described above. The support assembly (not shown) for attached to the shade assembly 1610 can be the same as, or similar to, the support assembly 1320 described above. The supporting frame 1620 can extend approximately 50-60 percent of the overall length LS1 of the shade assembly 1610 in this embodiment, thereby providing sufficient structural integrity and rigidity for a wide range of sizes and spans of shade.

Figure 17:
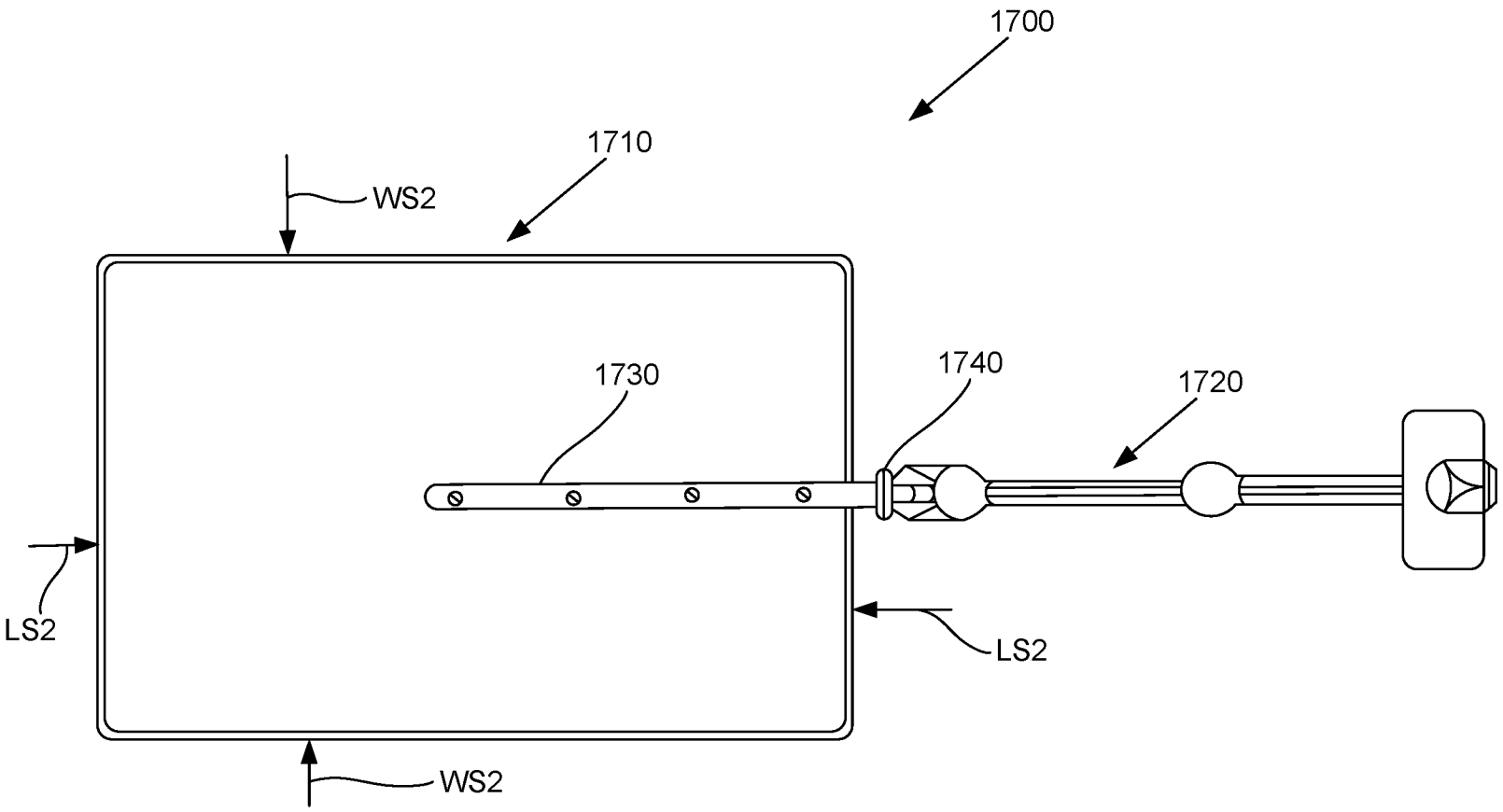
FIG. 17 is a bottom view of an adjustable personal shade according to an alternate embodiment in which the shade defines a square or rectangular perimeter showing a centrally mounted supporting frame in the form of a rib or bar.

Reference is now made to FIG. 17, which shows a rectangular-shaped shade assembly 1710 according to an alternate embodiment. The shade assembly defines a width WS2 of (e.g.) between approximately 12 and 30 and a length LS2 of between approximately 22 and 42 inches. The illustrative embodiment employs a central bar 1730 similar to the bar 1410 described above. The bar 1730 extends approximately 60 percent of the length LS2 of the rectangular shade assembly 1710 to a base 1740 also similar to the base 1420 described above.

Figure 18:
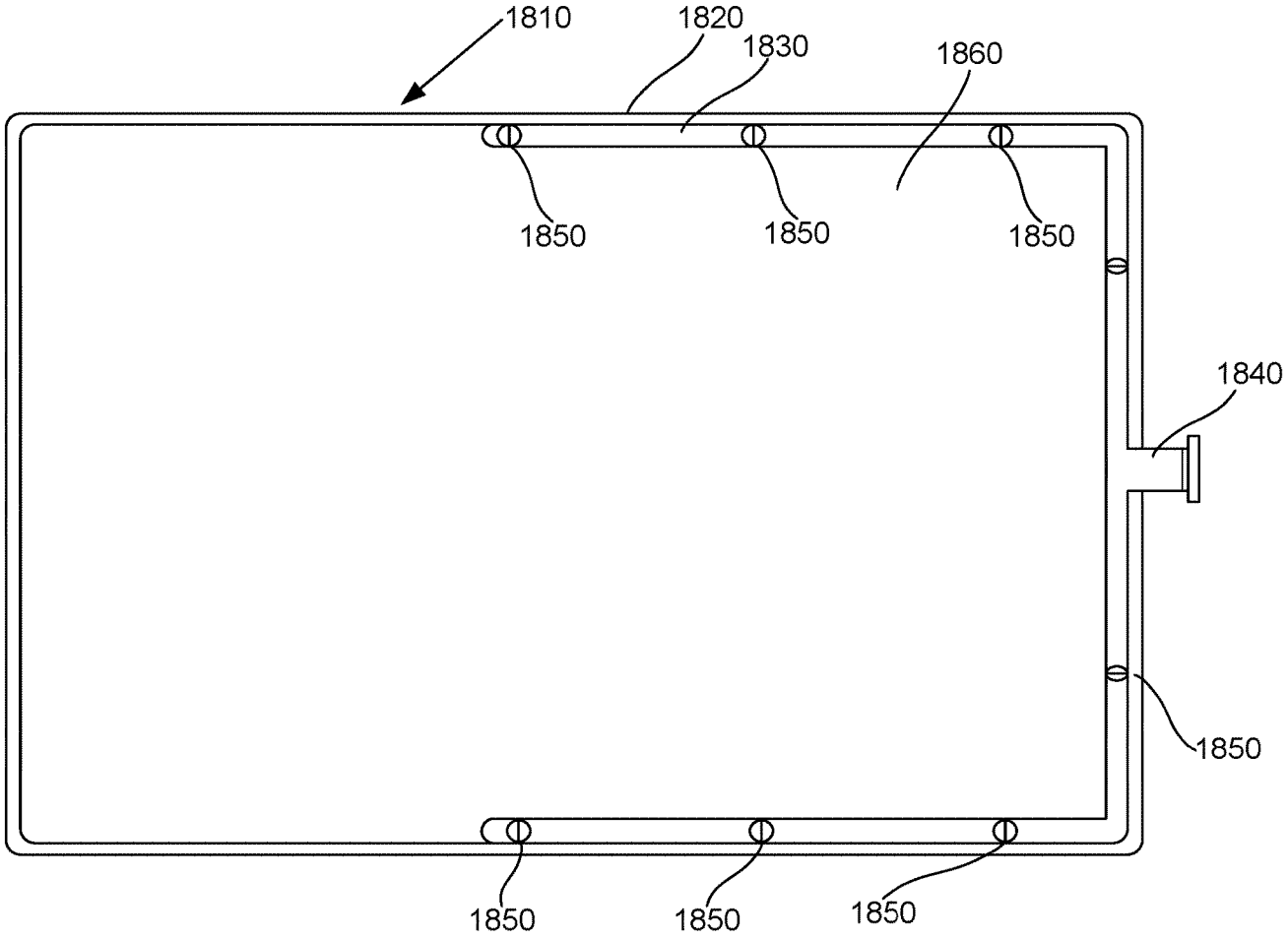
FIG. 18 is an adjustable personal shade according to an alternate embodiment including a supporting frame that is that is arranged around apportion of the perimeter of the shade in the form of a U shape.

FIG. 18 shows a shade assembly 1810 according to another embodiment. This shade assembly defines a rectangular perimeter with a raised edge 1820 as described above (FIG. 17). A unitary supporting frame 1830 and base 1840 are provided to the shade assembly 1810 in this embodiment. The frame 1830 generally defies a rectilinear U-shape (two opposing L-shapes extending in opposite directions from the base 1840). The supporting frame 1830 is attached by screws 1850 and/or other fastening mechanisms to the shade material 1860, and extends around the perimeter relatively adjacent to the raised edge 1820. It should be clear that the depicted rectangular shape (as well as the above-described oval are exemplary of a wide range of regular and irregular geometric shapes including squares, circles, polygons and combinations thereof.

Figure 19:
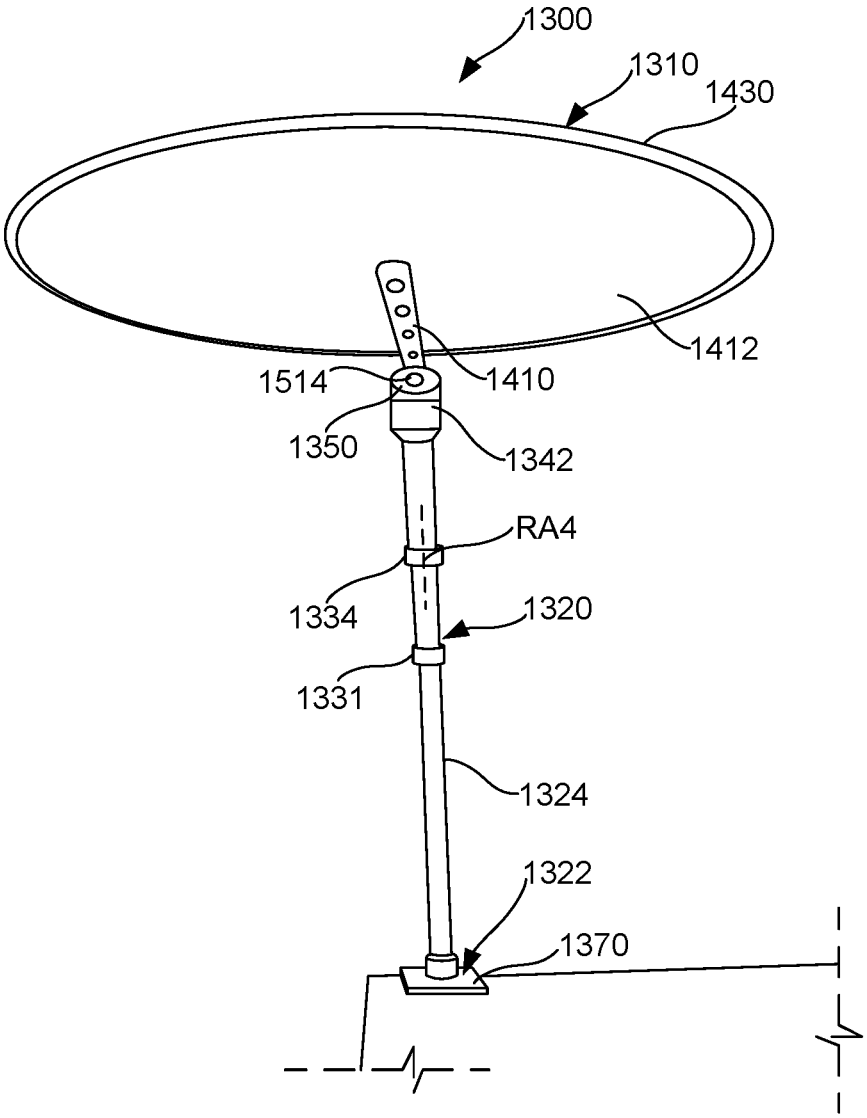
FIG. 19 is a perspective view of the adjustable personal shade of FIG. 13 shown in a first orientation in which the shade is viewed in a direct frontal position, and in which the illustrative support assembly is based upon an upright rod or pole and a multi-arm VESA-based monitor mount.
Figure 20:
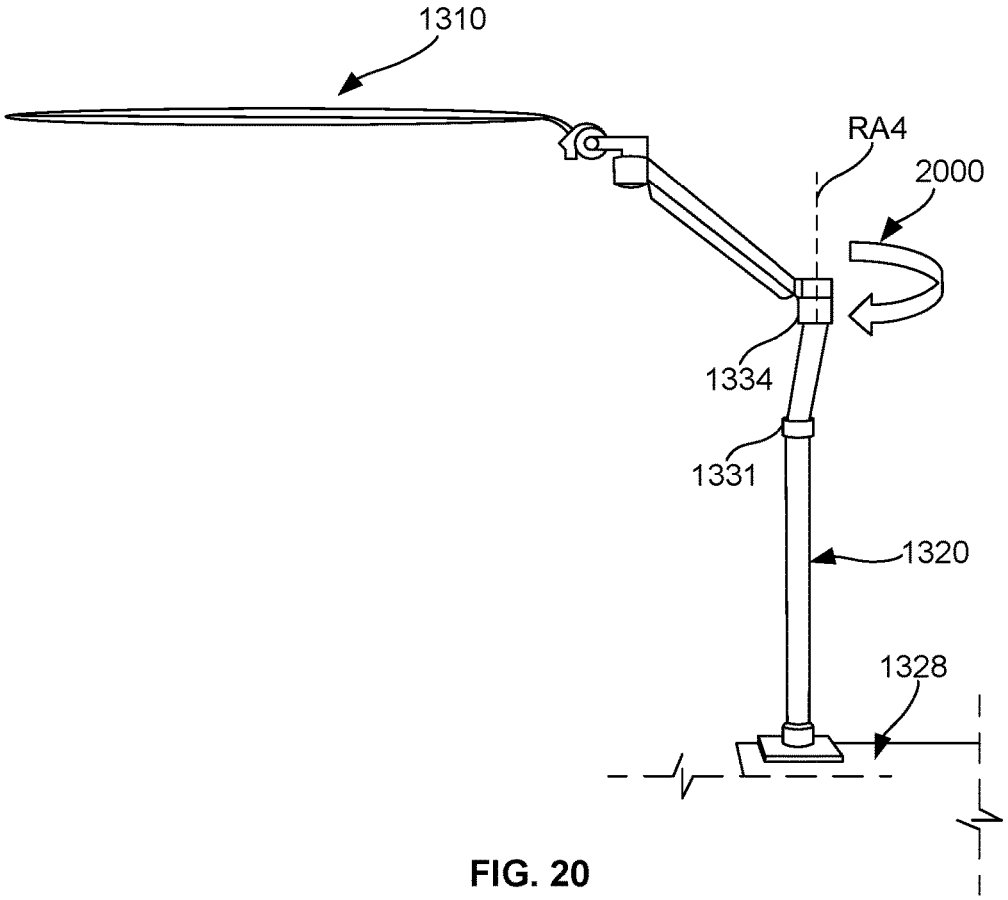
FIG. 20 is a perspective view of the adjustable personal shade from FIG. 19 in which the support assembly is rotated about a first axis.
Figure 21:
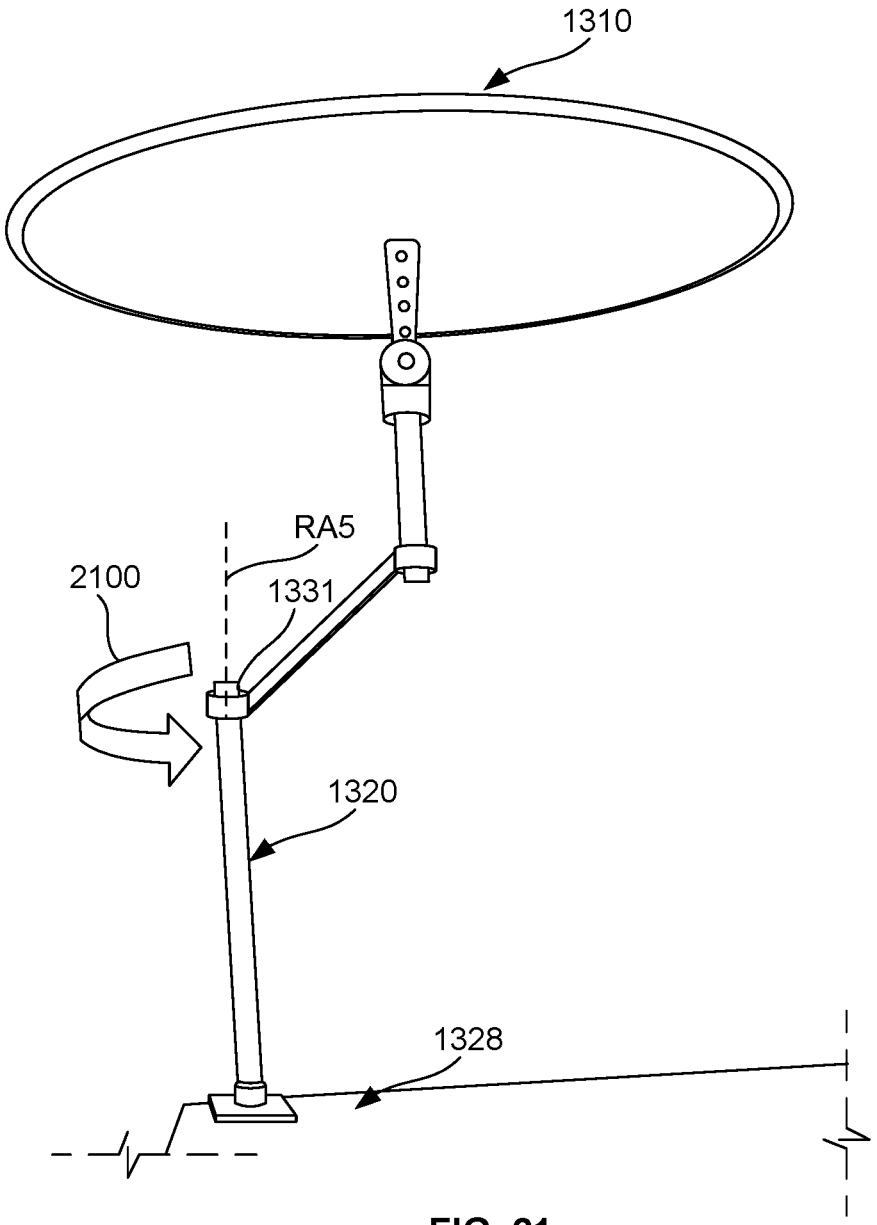
FIG. 21 is a perspective view of the adjustable personal shade from FIG. 20 in which the support assembly is rotated about a second axis.
Figure 22:
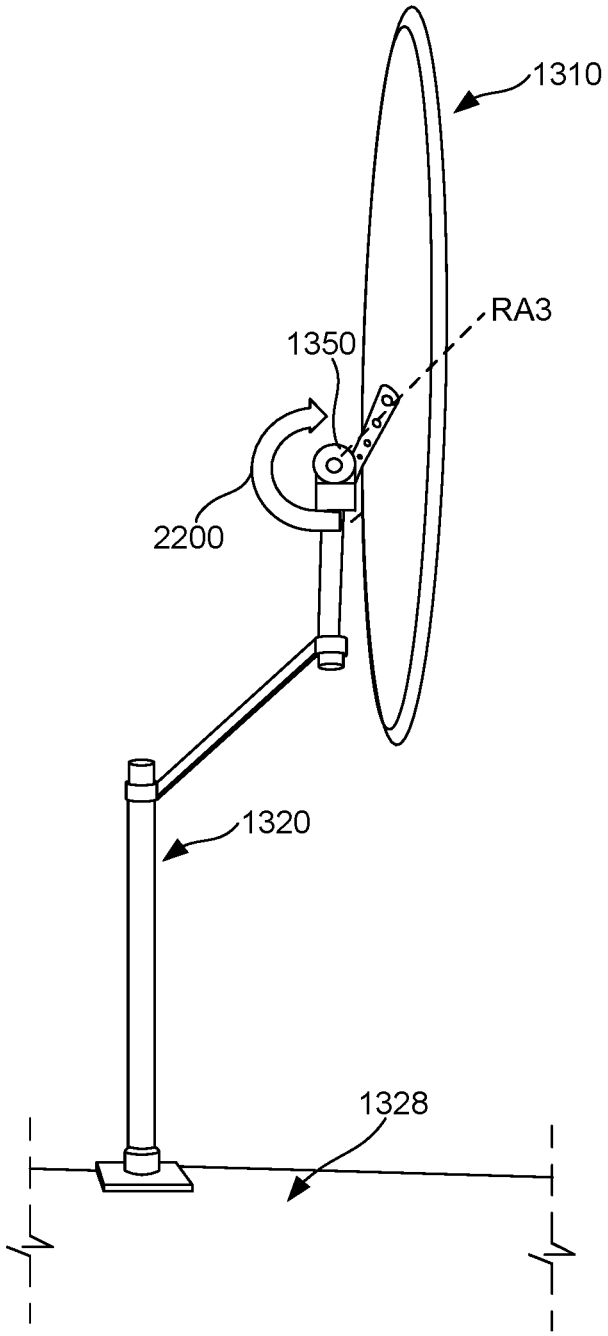
FIG. 22 is a perspective view of the adjustable personal shade from FIG. 21 in which the support assembly is rotated about a third axis.
Figure 23:
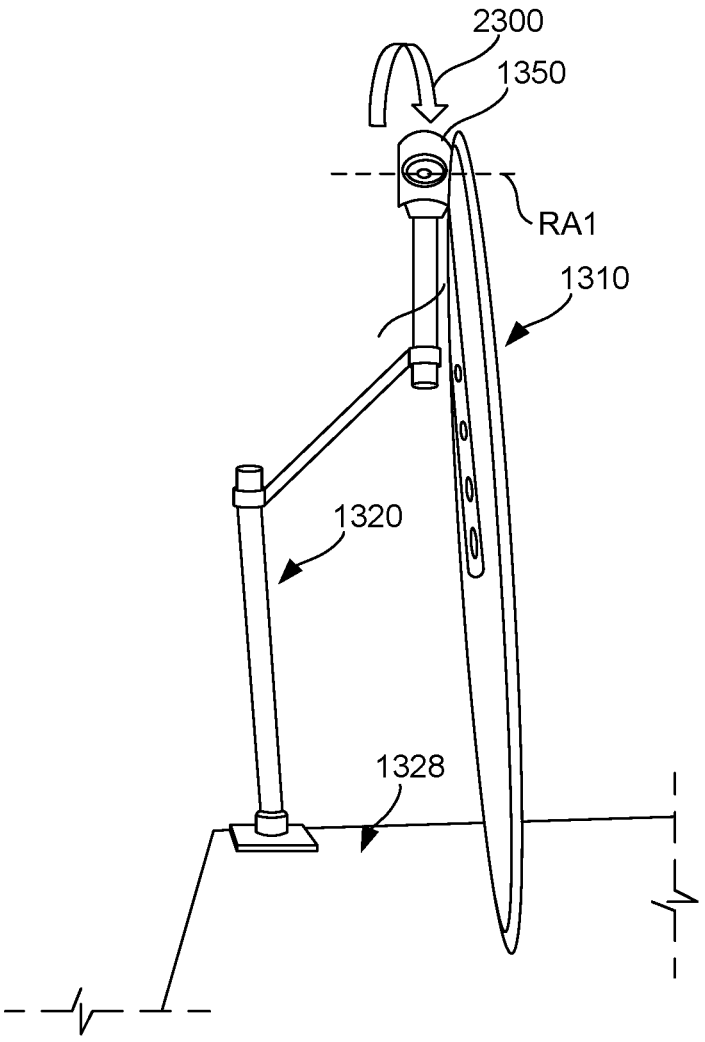
FIG. 23 is a perspective view of the adjustable personal shade from FIG. 22 in which the support assembly is rotated about a fourth axis.
Figure 24:
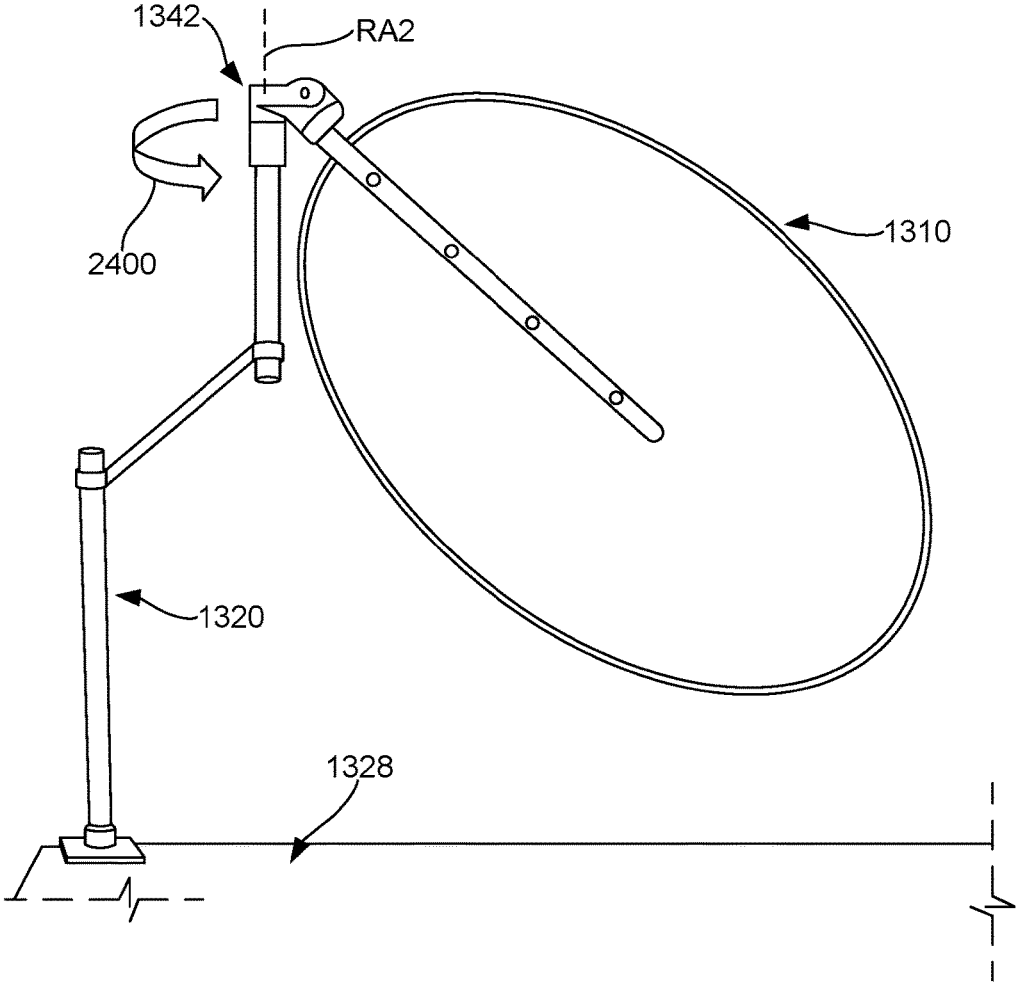
FIG. 24 is a perspective view of the adjustable personal shade from FIG. 23 in which the support assembly is rotated about a fifth axis.
Figure 25:
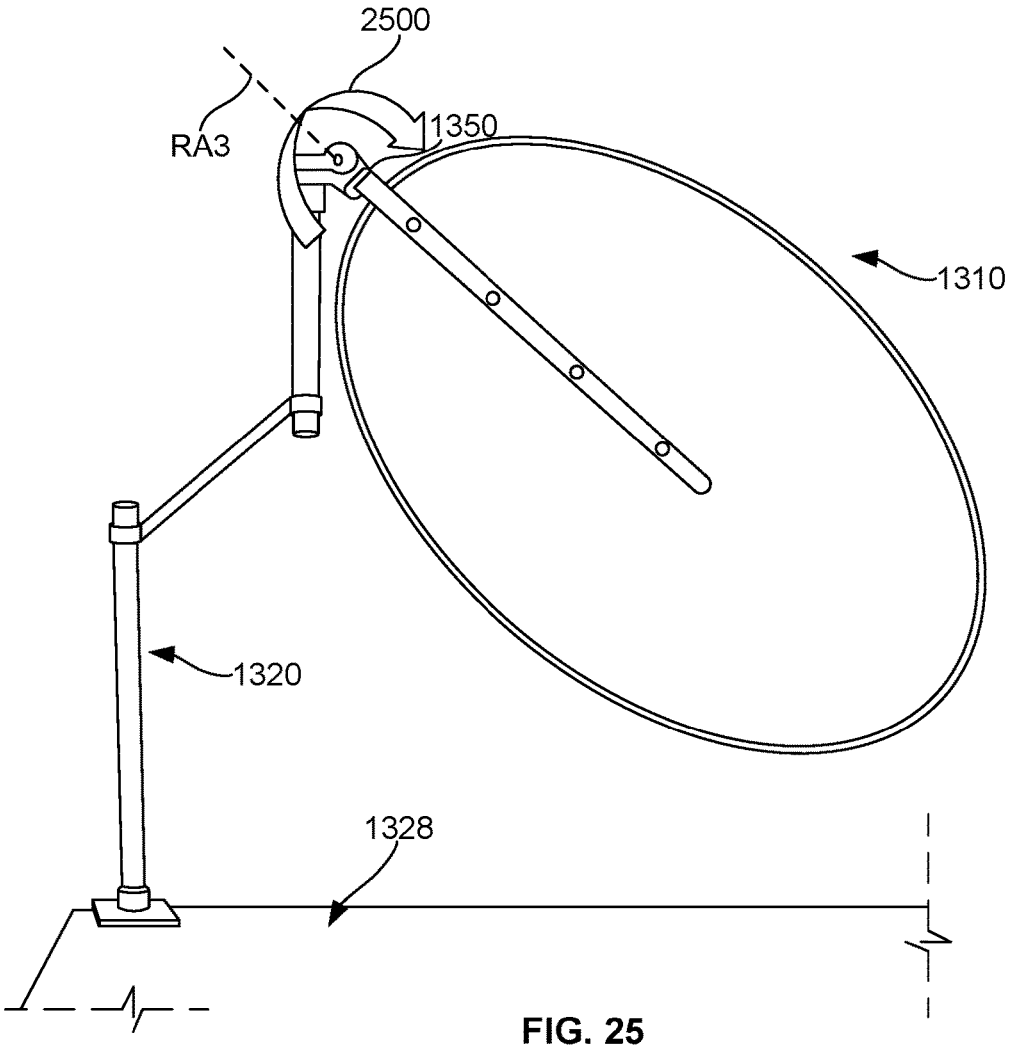
FIG. 25 is a perspective view of the adjustable personal shade from FIG. 19 in which the support assembly is rotated about the third axis.

FIGS. 19-25 depict relative motion of the shade arrangement 1300 (as described in FIGS. 13-15) according to a series of exemplary adjustment moves. In FIG. 19 the shade assembly 1310 is shown in a front-on view with all joints in a "neutral" position. The shade assembly 1310 is the moved along joint 1334 (axis RA4) as indicated by arrow 2000 to the depicted position in FIG. 20. Next, in FIG. 21, the shade assembly 1310 is moved (arrow 2100) about the pole 1320 (axis RA5) via mounting ring 1331. The yaw motions in FIGS. 20 and 21 place the shade in an offset location with respect to the original front-on view of FIG. 19. Next, in FIG. 22, the shade assembly 1310 is tilted (arrow 2200) in a roll motion about joint 1350 (axis RA3). Next in FIG. 23, the shade assembly 1310 is tilted (arrow 2300) to adjust pitch about joint 1350 (axis RA1). Next, in FIG. 24, the tilted shade assembly is again yawed (arrow 2400) about joint 1342 (axis RA2) to adjust the angle of the shade. Then, in the exemplary move of FIG. 25, the shade assembly 1310 is adjusted to a final position by rolling (arrow 2500) the shade about the joint 1350 (axis RA3). This position represents and optimal position for protecting the seated (and/or standing) user against draft, light and/or peering eyes. Note that in practice, the adjustment process can entail motion about multiple joints/axes simultaneously.

III. Conclusion

It should be clear that the canopy system according to various aspects of the disclosure provides an aesthetically pleasing, versatile and highly functional arrangement for enhancing user privacy and reducing unwanted glare and/or air drafts in a variety of office environments. It generally avoids obtrusive structures that extend beyond the confines of a cubicle space, is readily adjustable and can be mounted in a variety of manners to a desktop (e.g. through slots, grommets and/or on the edge of the desktop), including a freestanding arrangement, generally free of clamps.

The adjustable personal shade arrangement for use in an office environment according to various embodiments improves the user's performance and productivity in the workplace. The shade arrangement is illustratively mounted to a desktop, is readily adjusted into numerous positions and provides the user personal comfort control over their environment. The shade arrangement protects the user from the glare of the sun and lights and air drafts. It promotes a more-healthy ergonomic environment as some individuals are sensitive to light, while others are sensitive to drafts. These sensitivities can result in medical conditions or ergonomic injuries as the individual takes steps to avoid such light and/or draft—which the presence of the shade helps to avoid. The shade also provides much-desired privacy in an open office environment.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. For example, Also, as used herein various directional and orientational terms (and grammatical variations thereof) such as "vertical", "horizontal", "up", "down", "bottom", "top", "side", "front", "rear", "left", "right", "forward", "rearward", and the like, are used only as relative conventions and not as absolute orientations with respect to a fixed coordinate system, such as the acting direction of gravity. In addition, the base structure of the canopy system can include pass-through holes for cable management and/or a variety of covers, with various geometric shapes/colors/patterns. In various examples, the canopy element can include lighting elements (e.g. an array of LED lights embedded within, and projecting through, the fabric, and/or surface-mounted on the underside). An appropriate battery source or power cord can be mounted-in/routed-through the base. In addition, while the canopy system is shown in conjunction with a desktop and flat surface, such as a countertop, tabletop, and the like, can accommodate the system in accordance with various aspects of the disclosure. Also while the base is shown and described using a clamp system, in a counterbalanced arrangement a clamp can be substituted for non-skid feet or suction cups. In the embodiment of an adjustable personal shade, the perimeter can be integral and constructed from a dissimilar material, such as aluminum alloy or composite. Also, the support frame can define a different shape than the described central bar, horseshoe or U, and can include additional legs or extensions or a differing shape—for example, a cross shape extending from the base. Accordingly, this description is meant to be taken only by way of example, and not to otherwise limit the scope of this invention.

What is claimed is:

1. A personal adjustable shade system for a workspace, the system comprising:

a shade assembly having a perimeter edge and a sheet material contained therein, the perimeter edge defining a predetermined perimeter shape within a plane;

a support frame connected to the shade assembly;

a support assembly having a mounting end that engages with the support frame via a rotary joint that provides rotation of the shade assembly about a first rotational axis that extends along the plane of the supporting frame, the support assembly comprising:

a first joint adapted to provide rotation of the shade assembly about a second rotational axis, a second joint adapted to provide rotation of the shade assembly about a third rotational axis that is orthogonal to the second rotational axis, a third joint adapted to provide rotation of the shade assembly about a fourth axis of rotation that is orthogonal to the second axis of rotation, a fourth joint adapted to provide rotation of the shade assembly about a fifth rotational axis that is parallel with the fourth rotational axis, and a post, wherein the fourth joint is adjustably fixed to the post so that it may be locked at a desired height along the post.

2. The personal adjustable shade system as set forth in claim 1 wherein the post is an upright post arranged to be attached to a desktop.

3. The personal adjustable shade system as set forth in claim 1 wherein the support assembly comprises a monitor mount.

4. The personal adjustable shade system as set forth in claim 1 wherein the support frame defines at least one of: a frame mounted about the perimeter edge; or a central bar, interconnected to the sheet material.

5. The personal adjustable shade system as set forth in claim 1 wherein the sheet material comprises a frosted translucent polymer.

6. The personal adjustable shade system as set forth in claim 1 wherein the sheet material comprises a polymer defining a non-clear tint.

7. The personal adjustable shade system as set forth in claim 6 wherein the tint is black or light-blocking.

8. The personal adjustable shade system as set forth in claim 6 wherein the tint is translucent white or a non-white translucent color.

9. The personal adjustable shade system as set forth in claim 1 wherein the sheet material comprises a layer of closed cell foam.

10. The personal adjustable shade system as set forth in claim 1 wherein the sheet material comprises at least one of a polycarbonate or acrylic polymer.

11. The personal adjustable shade system as set forth in claim 1 wherein a height of the shade assembly is variable.

12. A personal adjustable shade system for a workspace, the system comprising:

a shade assembly having a perimeter edge and a sheet material contained therein, the perimeter edge defining a predetermined perimeter shape;

a support assembly having a mounting end that engages with the shade assembly, the support assembly comprising:

a first arm connected at its proximal end to a first joint and at its distal end to a second joint, the first joint allowing rotation about a first axis and the second joint allowing rotation about a second axis which is parallel to the first axis, a second arm connected at its proximal end to the second joint and at its distal end to a third joint, the third joint allowing rotation about a third axis which is parallel to the first axis, a fourth joint connected to the third joint, the fourth joint allowing rotation about a fourth axis which is orthogonal to the third axis, and a fifth joint connected to the fourth joint, the fifth joint allowing rotation about a fifth axis which is orthogonal to the fourth axis, the fifth joint being located at the mounting end.

13. The personal adjustable shade system as set forth in claim 12 wherein the support assembly further comprises a post and wherein the first joint is connected to the post.

14. The personal adjustable shade system as set forth in claim 13 wherein the first joint can be locked at a desired height along the post.

15. The personal adjustable shade system as set forth in claim 12 wherein the first arm is a lower arm and the second arm is an upper arm.

16. A personal adjustable shade system for a workspace, the system comprising:

a shade assembly having a perimeter edge and a sheet material contained therein, the perimeter edge defining a predetermined perimeter shape;

a support assembly having a mounting end that engages with the shade assembly, the support assembly comprising:

a five joint system that allows the shade assembly to be rotated about three parallel axes and about two additional axes that are orthogonal to one another, wherein a force applied to the shade assembly causes rotation of multiple joints simultaneously and wherein the multiple joints are provided with a predetermined frictional resistance such that, after rotation of the multiple joints in response to the force, a position of the multiple joints remains relatively fixed.

17. The personal adjustable shade system as set forth in claim 16 wherein the support assembly further comprises a post and wherein one of the joints is connected to the post.

18. The personal adjustable shade system as set forth in claim 17 wherein the joint connected to the post can be locked at a desired height along the post.

19. The personal adjustable shade system as set forth in claim 16 further comprising a first arm and a second arm, the first arm and second arm being connected to one another at one of the joints.

* * * * *